US005949012A

United States Patent [19]

Ishii

[11] Patent Number: 5,949,012

[45] **Date of Patent: *Sep. 7, 1999**

[54] ELECTRONIC MUSICAL INSTRUMENT AND MUSIC PERFORMANCE INFORMATION INPUTTING APPARATUS CAPABLE OF INPUTTING VARIOUS MUSIC PERFORMANCE INFORMATION WITH SIMPLE OPERATION

[75] Inventor: Katsushi Ishii, Iwata, Japan

[73] Assignee: Kabushiki Kaisha Kawai Gakki Seisakusho, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/774,090

[22] Filed: Dec. 24, 1996

[30] Foreign Application Priority Data

Dec. 27, 1995 [JP] Japan ..... 7-353277
Jan. 9, 1996 [JP] Japan ..... 8-018319

[51] Int. Cl.[6] ..... G10H 1/18

[52] U.S. Cl. ..... 84/615; 84/626; 84/658; 84/653

[58] Field of Search ..... 84/615, 626, 633, 84/658, DIG. 7, 609–610, 634, 649–650, 666, 653

[56] References Cited

U.S. PATENT DOCUMENTS

| | | | |
|---|---|---|---|
| 5,027,689 | 7/1991 | Fujimori | 84/622 |
| 5,153,829 | 10/1992 | Furuya et al. | 364/419 |
| 5,247,131 | 9/1993 | Okamoto et al. | 84/658 |
| 5,265,516 | 11/1993 | Usa et al. | 84/600 |
| 5,448,008 | 9/1995 | Okamoo et al. | 84/658 |
| 5,665,927 | 9/1997 | Taki et al. | 84/609 |

*Primary Examiner*—William M. Shoop, Jr.
*Assistant Examiner*—Marlon Fletcher
*Attorney, Agent, or Firm*—Christie, Parker & Hale, LLP

[57] ABSTRACT

A music performance information inputting apparatus for inputting music performance information to be supplied to an electronic musical instrument is arranged by a switch and a touch panel. This switch is used to select single basic music performance information from plural types of basic music performance information stored in a table memory. The music performance information inputting apparatus changes the content of the single basic music performance information selected by the switch based on the data derived from the touch panel so as to produce music performance information. This music performance information is merged with another music performance information received by a receiving unit from an external appliance, and the merged music performance information is transmitted by a transmitting unit to the external appliance.

19 Claims, 19 Drawing Sheets

Fig. 5

EVENT FLAG BIT ALLOCATION

| BIT | ALLOCATION CONTENT |
|---|---|
| 7 | – |
| 6 | – |
| 5 | – |
| 4 | TOUCH-ON |
| 3 | TOUCH-OFF |
| 2 | MOVEMENT |
| 1 | BENDER RANGE CHANGE |
| 0 | OTHER SWITCH CHANGE |

Fig. 6

PARAMETER TABLE

| BIT | 7 | 6 | 5 | 4 | 3 | 2 | 1 | 0 | | |
|---|---|---|---|---|---|---|---|---|---|---|
| FIRST BYTE | 1 | 1 | 1 | 0 | 0 | 0 | 0 | 0 | E0 | STATUS(BENDER) |
| SECOND BYTE | 1 | 0 | 0 | 0 | 0 | 0 | 0 | 0 | 80 | DATA1 |
| THIRD BYTE | 1 | 0 | 0 | 0 | 0 | 0 | 0 | 0 | 80 | DATA2 |
| FOURTH BYTE | 0 | 0 | 0 | 0 | 0 | 0 | 1 | 1 | 03 | BYTE=3 |
| FIFTH BYTE | 1 | 1 | 0 | 1 | 0 | 0 | 0 | 0 | D0 | STATUS(AFTER TOUCH) |
| SIXTH BYTE | 1 | 0 | 0 | 0 | 0 | 0 | 0 | 0 | 80 | DATA1 |
| SEVENTH BYTE | 0 | 0 | 0 | 0 | 0 | 0 | 0 | 0 | 00 | DUMMY |
| EIGHTH BYTE | 0 | 0 | 0 | 0 | 0 | 0 | 1 | 0 | 02 | BYTE=2 |
| | | | | | | | | | | |
| i-TH BYTE | 1 | 0 | 1 | 1 | 0 | 0 | 0 | 0 | B0 | STATUS(VOLUME) |
| (i+1)TH BYTE | 0 | 0 | 0 | 0 | 0 | 1 | 1 | 1 | 07 | MIDI CONTROL NUMBER |
| (i+2)TH BYTE | 1 | 0 | 0 | 0 | 0 | 0 | 0 | 0 | 80 | DATA1 |
| (i+3)TH BYTE | 0 | 0 | 0 | 0 | 0 | 0 | 1 | 0 | 03 | BYTE=3 |

ELECTRONIC MUSICAL INSTRUMENT AND MUSIC PERFORMANCE INFORMATION INPUTTING APPARATUS CAPABLE OF INPUTTING VARIOUS MUSIC PERFORMANCE INFORMATION WITH SIMPLE OPERATION

BACKGROUND OF THE INVENTION

1. Field of the Invention

The present invention generally relates to an electronic musical instrument, and a music performance information inputting apparatus capable of inputting music performance information into the electronic musical instrument. More specifically, the present invention is directed to an electronic musical instrument and a music performance information inputting apparatus thereof capable of entering various types of music performance information in a simple operation.

2. Description of the Related Art

Conventionally, in keyboard type electronic musical instruments, the keyboard is employed as music performance information inputting apparatuses for inputting music performance information. Only paying an attention to the function capable of instructing tone generations, the respective keys of this keyboard may be regarded as switches turned ON/OFF in response to key on/key off operations. As a consequence, the keyboard merely may designate 12×i pieces of pitches such as pitch names of $C_i$, $C_i$#, $D_i$, $D_i$#, $E_i$, $F_i$, $F_i$#, $G_i$, $G_i$#, $A_i$, $A_i$#, and $B_i$ from the infinite number of the pitches. In these pitch names, the suffix of "i" represents octave. It should be understood that the above-described 12×i pieces of pitches are referred to as "specific pitches".

On the other hand, in general, electronic musical instruments can produce musical tones based on a plurality of timbre. Accordingly, players select desired timbre by using operation panels and thereafter play electronic musical instruments. In this case, tone generations are instructed by using a keyboard even when any sorts of timbre are selected. However, when predetermined sorts of timbre are selected by manipulating operation panels, there are certain possibilities that musical effects specific to the selected timbre could not be achieved by using only the keyboard.

In general, for instance, when a violin is played, vibratos are applied to a musical tone of the violin. However, in the case that an electronic musical instrument is played with timbre of a violin, it is not possible to apply vibratos to a musical tone of this violin by manipulating only a keyboard. In this case, such a vibrato effect is simulated by changing the pitches by manipulating a wheel, e.g., a bender wheel and a modulation wheel in the conventional electronic musical instrument.

However, when vibratos are applied, since players are required to simultaneously manipulate keyboards and wheels, high music playing techniques are necessarily needed.

Also, changing widths of pitches and changing speeds of pitches when vibratos are applied to musical tones of violins are very delicate. This very delicate change could be hardly realized by manipulating the wheels. This difficulty is caused by differences in the vibrato application operations. In other words, when the vibratos are applied to the generated musical tones of violins, the wheels are rotated, whereas when vibratos are produced by playing violins, strings are depressed and rubbed by players' fingers.

Furthermore, there are some cases that a sound volume is changed at the same time when vibratos are applied to musical tones. In this case, three manipulations must be carried out at the same time, namely a keyboard, a wheel, and a volume knob should be simultaneously manipulated. However, in the normal electronic music instrument, it is rather difficult to execute such simultaneous three-member manipulations. Also, there are certain possibilities that, for example, a sound volume and a pan-pot are varied at the same time during music play to thereby form a desirable sound field. In the normal electronic musical instrument, the sound volume control and the pan-pot control are performed by using separate handles. As a consequence, to form a desirable sound field, a plurality of handles must be simultaneously manipulated during music play, so that higher music performance techniques are necessarily required.

SUMMARY OF THE INVENTION

An object of the present invention is to provide a music performance information inputting apparatus capable of inputting various types of music performance information to be supplied to an electronic musical instrument by performing a simple manipulation.

Another object of the present invention is to provide an electronic musical instrument capable of inputting various types of music performance information by performing a simple manipulation.

To achieve the above-described first object, a music performance information inputting apparatus according to the present invention is comprised of:

- a touch panel for outputting positional data about a touched position;
- music performance information producing means for producing music performance information based upon the positional data outputted from the touch panel; and
- transmitting means for transmitting the music performance information produced by the music performance information producing means to an external appliance.

The above-described music performance information may involve various sorts of messages defined by, for instance, the MIDI standard, and/or various messages defined specific to models of electronic musical instruments.

The music performance inputting apparatus according to the present invention is further comprised of:

- storage means for storing plural types of basic music performance information; and
- selecting means for selecting one piece of basic music performance information from the plural types of basic performance information stored in the storage means, and
- wherein the music performance information producing means changes the content of the one piece of basic music performance information selected by the selecting means based upon the positional data derived from the touch panel to produce music performance information.

It should be noted that basic music performance information may include various sorts of messages such as a note-on message, a note-off message, a polyphonic key pressure message, a control change message, a program change message, a channel pressure message, and a pitch bend message, and also this basic music performance information implies such a message, only the status byte (first byte) of which is defined, and the parameter bytes (second byte and third byte) of which are undefined. In the case that, for instance, the pitch bend message is selected as the basic music performance information, the data derived from the touch panel is used as the data of the parameter byte (namely, bender value indicative of pitch shift amount). As a result, the pitch wheel change with a complete format is produced.

Accordingly, when the touch panel is depressed by the player's finger and his finger is swung along a preselected direction in such a simulation manner that strings of a violin are rubbed, the data is outputted from the touch panel in response to changes of his finger. This data is assembled as the bender value into the parameter byte of the pitch bend message, so that the pitch bend message with the complete format can be formed. Therefore, when this pitch bend message is supplied to the tone generator, it is possible to generate such a musical tone having very delicate changes with vibratos in the violin timbre.

The music performance information inputting apparatus according to the present invention is further comprised of:

receiving means for receiving externally supplied music performance information; and merging means for merging the externally supplied music performance information received by the receiving means with the music performance information produced by the music performance information producing means, and wherein the transmitting means transmits the music performance information merged by the merging means to the external appliance.

The music performance information is merged by the above-described merging means in such a way that the music performance information received by the receiving means and the music performance information produced by the music performance information producing means are arranged in a serial form, and a plurality of serially arranged music performance information are sequentially outputted to the external apparatus.

With this arrangement, the music performance information derived from the external electronic musical instrument and the computer and so on is merged with the music performance information produced from this music performance information inputting apparatus, and then the merged music performance information is sent out to the external apparatus. For example, when the note-on message is inputted from the external electronic music appliance, this note-on message, and for instance, the pitch bend message produced based on the data derived from the touch panel are sequentially outputted to the external apparatus. As a result, the musical tones with vibratos can be produced. In this case, the note-on message and the pitch bend message may be sequentially outputted in an arbitrary order.

The above-described touch panel outputs a coordinate value of an X axis and a coordinate value of a Y axis of the touched position;

the selecting means selects single basic music performance information from the plural types of basic music performance information stored in the storage means as first basic music performance information allocated to the X axis, and also selects single basic music performance information from the plural types of basic music performance information stored in the storage means as second basic music performance information allocated to the Y axis; and the music performance information producing means changes the content of the first basic music performance information selected by the selecting means based on the coordinate value of the X axis outputted from the touch panel to produce first music performance information, and also changes the content of the second basic music performance information selected by the selecting means based on the coordinate value of the Y axis outputted from the touch panel to produce second music performance information.

In accordance with this arrangement, since two sets of music performance information can be produced at the same time by one-touch operation, the music performance information can be simply inputted. For instance, when a selection is made of such basic music performance information capable of controlling the sound volume as the first basic music performance information and the pan-pot as the second basic music performance information, the desirable volume and pan-pot can be determined by one-touch operation. As a consequence, it is possible to produce a desirable sound field in a simple manner during music play even by any beginners. It should be noted that the two parameters contained in single music performance information may be allocated to the X axis and the Y axis, respectively. For instance, the X axis and the Y axis may be allocated to the respective bytes of the MIDI message having the 2-byte variable data.

Also in this case, the music performance information inputting apparatus is further comprised of:

receiving means for receiving externally supplied music performance information; and merging means for merging the externally supplied music performance information received by the receiving means with the first and second music performance information produced by the music performance information producing means, and wherein the transmitting means transmits the music performance information merged by the merging means to the external appliance.

Also, the touch panel outputs a coordinate value of an X axis, a coordinate value of a Y axis, and a coordinate value of a Z axis of the touched position;

the selecting means selects single basic music performance information from the plural types of basic performance information stored in the storage means as first basic music performance information allocated to the X axis, selects single basic music performance information from the plural types of basic music performance information stored in the storage means as second basic music performance information allocated to the Y axis, and also selects single basic music performance information from the plural types of basic music performance information stored in the storage means as third basic music performance information allocated to the Z axis; and the music performance information producing means changes the content of the first basic music performance information selected by the selecting means based on the coordinate value of the X axis outputted from the touch panel to produce first music performance information, changes the content of the second basic music performance information selected by the selecting means based on the coordinate value of the Y axis outputted from the touch panel to produce second music performance information, and also changes the content of the third basic music performance information selected by the selecting means based upon the coordinate value of the Z axis outputted from the touch panel to produce third music performance information.

Also in this case, the music performance information inputting apparatus is further comprised of:

receiving means for receiving externally supplied music performance information; and merging means for merging the externally supplied music performance information received by the receiving means with the first, second and third music performance information produced by the music performance information producing means, and wherein the transmitting means transmits the music performance information merged by the merging means to the external appliance.

According to this arrangement, the first basic music performance information, the second basic music performance information, and the third basic music performance information are allocated to the X axis, the Y axis, and the Z axis, respectively. When the data indicative of the coordinate value and the depression force of the touched position is sent from the touch panel, the first music performance information, the second music performance information, and the third music performance information are produced based on the data. As a result, since three sets of music performance information can be simultaneously produced by one touch operation, the music performance information can be simply inputted.

For instance, if the sound volume is allocated as the first basic music performance information to the X axis, the pan-pot is allocated as the second basic music performance information to the Y axis, and the timbre (cut-off frequency of filter) is allocated as the third basic music performance information to the Z axis, then the desired volume and pan-pot can be determined by one-touch operation, and further the timbre can be changed. As a consequence, the desirable sound field can be formed during music play even by such a player who has no high music performance techniques, and furthermore, the desirable timbre can be obtained.

To achieve the second object, an electronic musical instrument, according to the present invention, is comprised of:

music performance information inputting means for producing music performance information in response to a input operation; and musical tone generating means for generating a musical tone based on the music performance information produced by the music performance information inputting means;

the music performance information inputting means is constituted by:

a touch panel for outputting positional data about a touched position; and music performance information producing means for producing music performance information based upon the positional data outputted from the touch panel.

The above-explained music performance information contains information used to determine various sound elements, for instance, pitches, sound volumes, timbre, and musical effects. When the touch panel is touched by the finger, the music performance information inputting means produces the music performance information indicative of "key-on", whereas when the finger is removed from the touch panel, this music performance information inputting means produces the music performance information representative of "key-off". Then, the pitch is determined based on the touched position. In accordance with this electronic musical instrument, not only the specific pitch generated by manipulating the conventional keyboard, but also an arbitrary pitch, for example, a pitch produced during pitch bend can be entered.

The above-described touch panel outputs a coordinate value of an X axis and a coordinate value of a Y axis of the touched position; and the music performance information producing means produces music performance information (will be referred to as "pitch information" hereinafter) used to designate a pitch based upon the coordinate value of the X axis outputted from the touch panel, and also produces another music performance information (will be referred to as "non-pitch information" hereinafter) other than the pitch information based on the coordinate value of the Y axis outputted from the touch panel.

With employment of the above-described arrangement, the music player can input the music performance information used to generate sound with an arbitrary pitch by moving his finger on the touch panel along the right/left directions. Also, the music player can input the non-pitch information used to control, for example, sound volume and timbre by moving his finger on the touch panel along the upper/lower directions.

As a consequence, since the music player changes his touched position on the touch panel, a plurality of sound elements such as the pitch and sound volume, or the pitch and timbre can be changed at the same time by one-touch operation. Also, since the music player moves his finger along the oblique direction while touching his finger on the touch panel, such a music performance is possible that the sound volume is changed while the pitch bend is made effective. Otherwise, since the music player moves his finger along the oblique direction while touching his finger on the touch panel, such a music performance is available that while the pitch bend is made effective, the timbre is varied by controlling, for instance, the cut-off frequency of the filter.

It should also be noted that the non-pitch information may correspond to the X axis, and the pitch information may correspond to the Y axis. In this case, when the music player moves his finger on the touch panel along the upper/lower directions, the pitches are changed, whereas when the music player moves his finger on the touch panel along the right/left directions, the sound volume and the timbre and so on are changed.

Also, the electronic musical instrument may be so arranged that a plurality of music performance information can be produced based on the coordinate value of the X axis, and a plurality of music performance information can be produced based on the coordinate value of the Y axis. For instance, it is also possible to arrange such that the pitch information, and the non-pitch information (for example, any one of sound volume, right/left localization, front/rear localization, and cut-off frequency or resonance frequency of filter) are produced based upon, for instance, the coordinate value of the X axis. Similarly, it is also possible to arrange such that one non-pitch information (any one of modulation depth, speed, and wave form/volume ratio), and another non-pitch information (any one of modulation depth, speed, and wave form/volume ratio) are produced based on the coordinate value of the Y axis.

The above-described touch panel outputs a coordinate value of an X axis, a coordinate value of a Y axis, and a coordinate value of a Z axis of the touched position; and the music performance information producing means produces music performance information used to designate a pitch based upon the coordinate value of the X axis outputted from the touch panel, and also produces another music performance information other than the music performance information for designating the pitch based on the coordinate value of the Y axis and the coordinate value of the Z axis outputted from the touch panel.

For instance, the music performance information producing means can be arranged to produce such music performance information for designating the pitch based on the coordinate value of the X axis, the sound volume based upon the coordinate value of the Y axis, and the timbre based on the coordinate value of the Z axis. In this case, since the music player changes the touched position on the touch panel and the depression force against the touch panel, a plurality of sound elements such as the pitch, the sound volume, and the timbre can be changed at the same time by one-touch operation. Also, since the music player moves his finger along the oblique direction while touching his finger on the touch panel, such a music performance is available that while the pitch bend is made effective, the sound volume is changed, and the timbre is varied by controlling, for instance, the cut-off frequency of the filter.

It should also be noted that the present invention is not limited to the above-described corresponding relationship among the pitch information, the non-pitch information, and the respective coordinate axes. Similar to the above case, a plurality of music performance information may be allocated to the respective X axis, Y axis, and Z axis.

The above-explained music performance information producing means produces music performance information used to designate a pitch based upon the coordinate value of the X axis outputted from the touch panel when the touch panel is touched, and also when the touched position is moved while the touch panel is touched. In this case, at the same time, it is possible to construct that the non-pitch information is produced from the coordinate value of the Y axis derived from the touch panel.

With this arrangement, since the music performance information is directly produced based on the coordinate value of the touched position of the touch panel, there is a merit that the pitch, sound volume, and timbre can be intuitively designated.

Also, the above-mentioned music performance information producing means produces music performance information used to designate a specific pitch based on the coordinate value of the X axis outputted from the touch panel when the touch panel is touched, and also produces another music performance information used to designate a pitch in response to a movement amount of the touched position when the touched position is moved while the touch panel is touched. In this case, in the case that the specific non-pitch information is simultaneously produced based on the coordinate value of the Y axis and/or the coordinate value of the Z axis derived from the touch panel, and the touched position is moved while touching the touch panel, the parameter contained in the non-pitch information is varied in response to the move amount of this touch position.

For example, a picture of a keyboard is drawn on the touch panel, and the music performance information producing means may be arranged as follows. That is, this music performance information producing means produces the music performance information used to designate the specific pitch corresponding to such a key if a first touched position is located within a preselected range of the keyboard picture, and thereafter the pitch is changed in response to the move amount of the touched position. Similarly, the music performance information producing means may be arranged to produce the non-pitch information in such a way that when the touch panel is first touched, predetermined non-pitch information is produced, and thereafter a value thereof (for instance, sound volume value, and coefficient value for designating cut-off frequency of filter) is changed in response to the move amount of the touched position.

In accordance with this arrangement, the pitch bend can be easily simulated on the touch panel. Also, the sound volume and the timbre can be readily changed on the touch panel.

Also, the electronic musical instrument of the present invention is further comprised of transmitting means. This transmitting means transmits the music performance information produced by the music performance information producing means to an external apparatus. It is possible to control other electronic musical instruments, a tone generating module, a sequencer, and a computer by this music performance information inputting apparatus in accordance with the above-described arrangement.

BRIEF DESCRIPTION OF THE DRAWINGS

The present invention may be understood by reading a detailed description in conjunction with the accompanying drawings, in which:

FIG. 5 illustrates an example of a bit allocation of the event flag shown in FIG. 4;

FIG. 6 schematically indicates an example of a parameter table used in the music performance information inputting apparatus of the first embodiment;

DESCRIPTION OF THE PREFERRED EMBODIMENTS

Referring now to drawings, various preferred embodiments of music performance information inputting apparatuses of electronic musical instruments according to the present invention will be described in detail.

OVER VIEW OF FIRST PREFERRED EMBODIMENT

In a music performance information inputting apparatus according to a first embodiment of the present invention, MIDI (Musical Instrument Digital Interface) format data is used as music performance information. It should be noted that the music performance information used in the present invention is not limited to this MIDI format data, and therefore the music performance information input apparatus according to the present invention may handle various formats of data.

Figure 1:
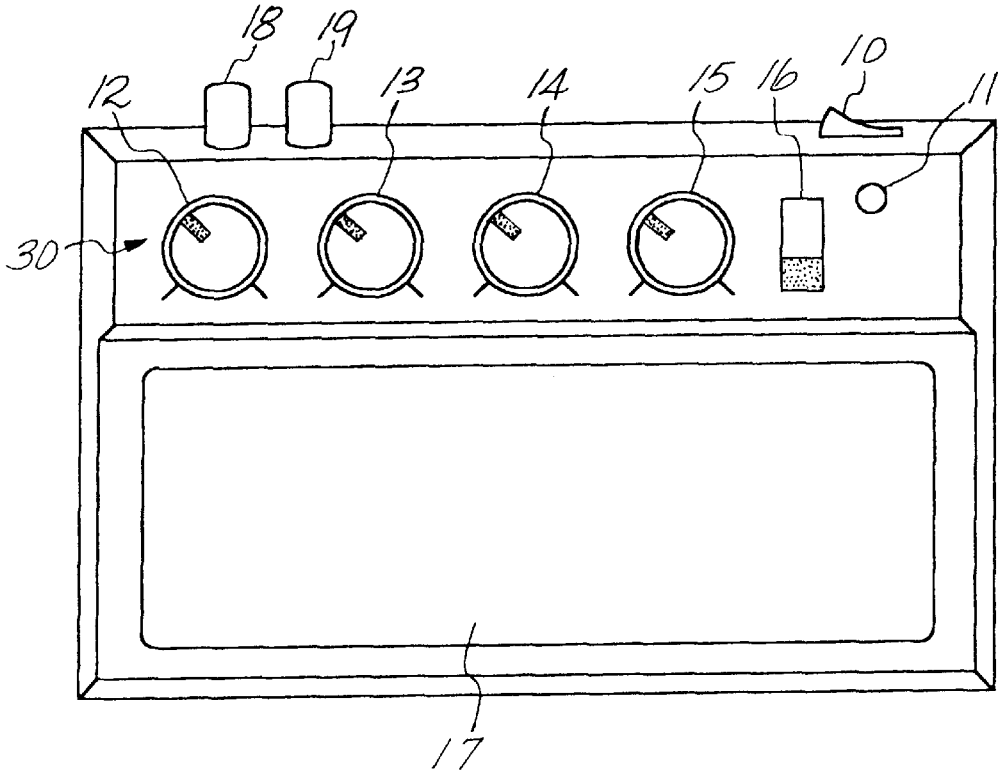
FIG. 1 is an outer view for showing a music performance information inputting apparatus, as viewed from an upper surface of this inputting apparatus, according to a first embodiment of the present invention.

FIG. 1 is an outer view for showing the music performance information inputting apparatus according to the first embodiment of the present invention, as viewed from an upper surface thereof. This music performance information inputting apparatus contains a power supply switch 10, a touch panel 17, an MIDI input terminal 18, an MIDI output terminal 19, and an operation panel 30.

The power supply switch 10 is used to turn ON/OFF the music performance information inputting apparatus. When the power supply switch 10 is turned ON, a power indicator 11 mounted on the operation panel 30 is turned ON.

The touch panel 17 detects, for instance, a position where an operator touches his finger, and then outputs a detection result as a coordinate value. This coordinate value is constructed of a coordinate value of an X-axis (right/left direction of FIG. 1), and a coordinate value of a Y-axis (upper/lower direction of FIG. 1). The touch panel 17 may be arranged by employing, for instance, an analog type touch panel, a digital type touch panel, and other various types of touch panels well known in the field. The analog type touch panel may detect touch-on/off states and touch positions based on variations in resistance values or electrostatic capacitances. The digital type touch panel may detect touch-on/off states and touch positions based upon on/off states of very small switches arranged in a mesh form.

The MIDI input terminal 18 is used so as to receive an MIDI message supplied from an external apparatus. As this external apparatus, an electronic musical instrument, a sequencer, a computer, and various types of apparatuses capable of outputting MIDI format data may be employed.

The MIDI output terminal 19 is utilized so as to transmit the MIDI message received from the external apparatus, and another MIDI message produced by the music performance information input apparatus of this first embodiment to an external apparatus. This MIDI output terminal 19 is connected to, for example, a tone generating unit.

The operation panel 30 is provided with an MIDI channel selecting switch 12, a bender range selecting switch 13, an X parameter allocating switch 14, a Y parameter allocating switch 15, and a bender mode switch 16 in order to control this music performance information inputting apparatus.

The MIDI channel selecting switch 12 is used so as to select an MIDI channel number. This MIDI channel selecting switch 12 is constituted by, for example, a rotary type switch having 16 click stop positions. The first to sixteenth click stop positions correspond to the MIDI channel numbers "0" to "15" respectively. An MIDI channel number selected by this MIDI channel selecting switch 12 is utilized as a pant of an MIDI message produced in this music performance information inputting apparatus.

The bender range selecting switch 13 is employed so as to select a bender range. This bender range selecting switch 13 may be constructed of, for instance, a rotary type switch capable of designating a value range of "0" to "127". A value selected by this bender range selecting switch 13 is employed as data for restricting a change range of a pitch.

A selecting means of the present invention is arranged by the X parameter allocating switch 14 and the Y parameter allocating switch 15. The X parameter allocating switch 14 is used in order to select a type of an MIDI message which is allocated to the X axis of the touch panel 17. Similarly, the Y parameter allocating switch 15 is used so as to select a type of an MIDI message which is allocated to the Y axis of the touch panel 17. The X parameter allocating switch 14 and the Y parameter allocating switch 15 may be arranged by, for instance, a rotary type switch capable of designating one number among a plurality of numbers. The numbers designated by the X parameter allocating switch 14 and the Y parameter allocating switch 15 are utilized as parameter numbers. An example of MIDI messages which may be allocated to the X axis and the Y axis is represented in table 1. It should be noted that a specific number is given to each of these MIDI messages.

TABLE 1

| [number] | [parameter] | [output data (hexadecimal number)] |
|---|---|---|
| 1 | bender | Enllmm |
| 2 | after touch | Dndd |
| 3 | modulation depth | Bn01dd |
| 4 | volume | Bn07dd |
| 5 | pan-pot | Bn0Add |
| 6 | general-purpose effect depth 1 | Bn5Cdd (tremolo depth) |
| 7 | effect depth 3 | Bn5Ddd (chorus depth) |
| 8 | effect depth 4 | Bn5Edd (celeste depth) |

It should be understood that symbol "n" indicates the MIDI channel number, and is equal to a value in a range of 0H to FH. Symbol "H" located at the last digit denotes hexadecimal number, and this definition is similarly applied to the below-mentioned descriptions. Symbol "11" represents an upper-digit byte of a bender value. Symbol "mm"

represents a lower-digit byte of a bender value. These symbols "11" and "mm" are produced based upon the respective coordinate values of the X axis and the Y axis. Symbols "dd" is produced based upon the coordinate value of either the X axis or the Y axis. These symbols "11", "mm", and "dd" are values of the range from 00H to 7FH.

The bender mode switch 16 is used to designate an input mode in which a bender value is inputted by using the touch panel 17 (will be referred to as a "bender mode" hereinafter). The bender mode is arranged by an absolute value mode and a relative value mode. In the absolute value mode, the coordinate value of a present touched position, entered from the touch panel 17, is used as the bender value. On the other hand, in the relative value mode, a coordinate value is used as the bender value, which is constituted by a difference between a coordinate value of a first touch position and a coordinate value of a present touch position. In this embodiment, all of the coordinate values are handled as absolute values other than such a case that the bender value is inputted. This bender mode switch 16 may be constituted by, for instance, a slide type switch having two contacts.

Figure 2:
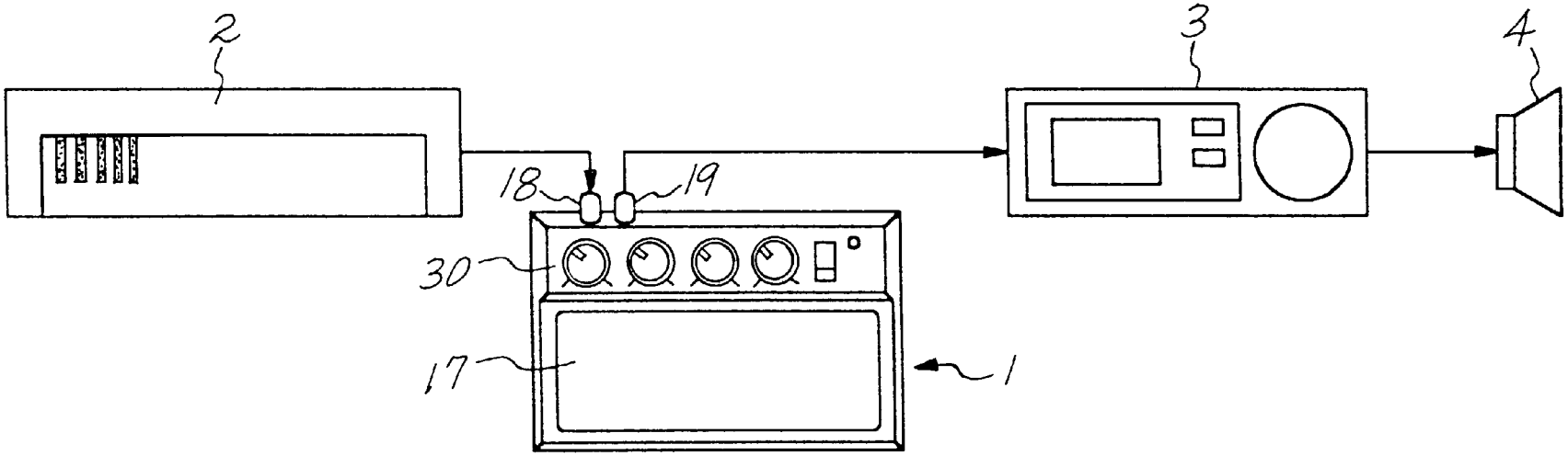
FIG. 2 is an explanatory diagram for explaining application of the music performance information inputting apparatus to music performance, according to the first embodiment of the present invention.

The music performance information inputting apparatus according to the present invention is used under such a condition as shown in, for example, FIG. 2. That is, in this music performance information inputting apparatus 1, an MIDI message issued from, for example, the MIDI keyboard 2 is received by an MIDI input terminal 18, both this received MIDI message and another MIDI message produced by operating the touch panel 17 and the operation panel 30 are merged with each other, and the merged message is outputted from an MIDI output terminal 19 to an external apparatus. The merged MIDI message derived from the MIDI output terminal 19 is supplied to the tone generator 3. Then, a musical tone is produced in the tone generator 3 in response to this MIDI message and is then supplied to a loud speaker 4. As a result, the musical tone is generated based on the MIDI message produced by operating the MIDI keyboard 2 and the music performance information input apparatus 1. Accordingly, in such a case that, for instance, a musical tone with vibrato is generated, the touch panel 17 of the music performance information inputting apparatus 1 may be touched with vibration while manipulating the MIDI keyboard 2.

ARRANGEMENT OF FIRST MUSIC PERFORMANCE INFORMATION INPUTTING APPARATUS

An internal electronic arrangement of the music performance information inputting apparatus 1 will now be described with reference to a block diagram of FIG. 3. It should be understood that the touch panel 17 and the operation panel 30 indicated in FIG. 3 have been explained.

Figure 3:
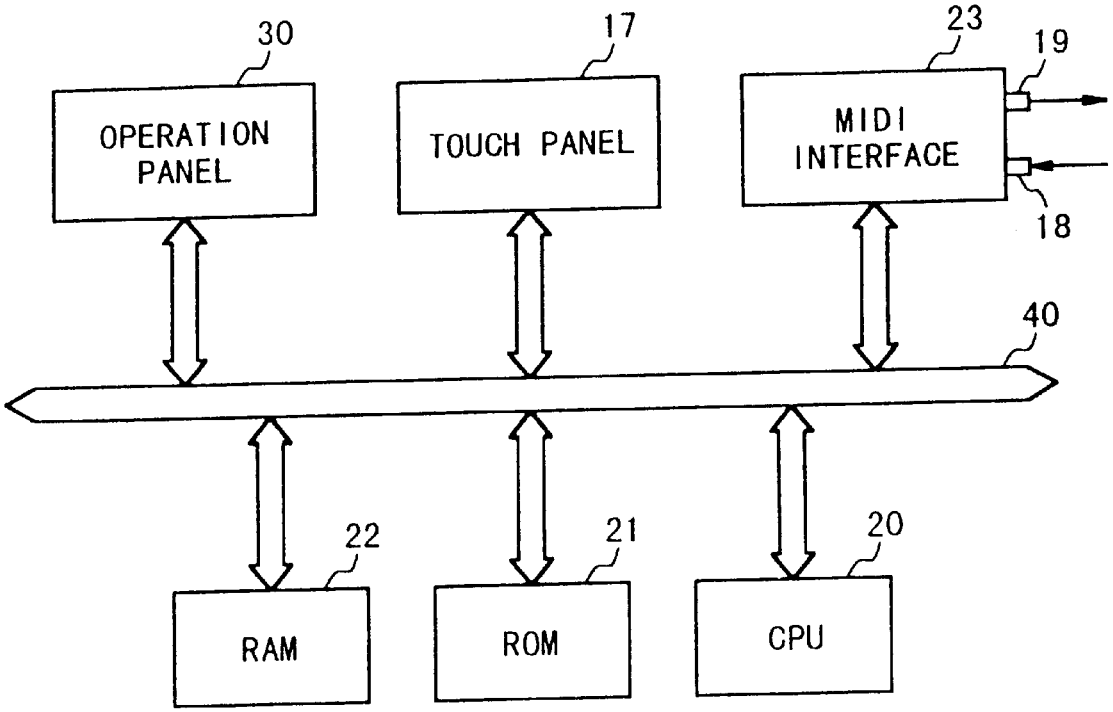
FIG. 3 is a schematic block diagram for representing an arrangement of the music performance information inputting apparatus according to the first embodiment of the present invention.

In FIG. 3, a central processing unit (will be referred to as a "CPU" hereinafter) 20 corresponds to a music performance information generating means according to the present invention. The CPU 20 controls various units of this music performance information inputting apparatus 1 by sequentially reading out a control program stored in a read-only memory 21 (will be referred to as a "ROM" hereinafter) via a system bus 40 and then sequentially executing the read control program.

In addition to the control program, various fixture data are stored in the ROM 21. Also, a parameter table indicated in FIG. 6 is previously stored in this ROM 21. This parameter table corresponds to a storage means according to the present invention, and stores thereinto data indicative of a basic pattern of the MIDI message. The data stored in this parameter table are designated by parameter numbers supplied from either the X parameter allocating switch 14 or the Y parameter allocating switch 15.

A basic pattern of MIDI message of pitch wheel changes is composed of the first byte data to the fourth byte data of the parameter table. The upper 4 bits of the first byte data (namely, bits 7 to 4) correspond to a status indicative of the pitch wheel change. The lower 4 bits of the first byte data (namely, bits 3 to 0) correspond to an MIDI channel number. To this portion, the MIDI channel number selected by the MIDI channel selecting switch 12 is set. Bender values are set to the second byte portion and the third byte portion of the basic pattern. As these bender values, an X coordinate value XX and a Y coordinate value YY, which are designated by the touch panel 17 are used. The fourth byte data corresponds to such data for indicating that this MIDI message is constructed of 3-byte effective data.

A basic pattern of MIDI message of channel pressure (after touch) is composed of the fifth byte data to the eighth byte data. Similar to the above case, the fifth byte data corresponds to a status and an MIDI channel number. A pressure value is set to the sixth byte portion. As this pressure value, the X coordinate value XX designated by the touch panel 17 is used. It should be noted that the seventh byte data is not utilized. The eighth byte data corresponds to such data for representing that this MIDI message is constituted of 2-byte effective data.

A basic pattern of MIDI message of control change (volumes)is composed of the i-th byte data to the (i+3)th byte data. Similar to the above-case, the i-th byte data corresponds to a status and an MIDI channel number. An MIDI control number is set to the (i+1)th byte portion. This control number instructs that the volume is changed. A volume value is set to the (i+2)th byte portion. As the volume value, the X coordinate value XX designated by the touch panel 17 is used. The (i+3)th byte data corresponds to such data for indicating that this MIDI message is constructed of 3-bytes effective data.

Figure 4:
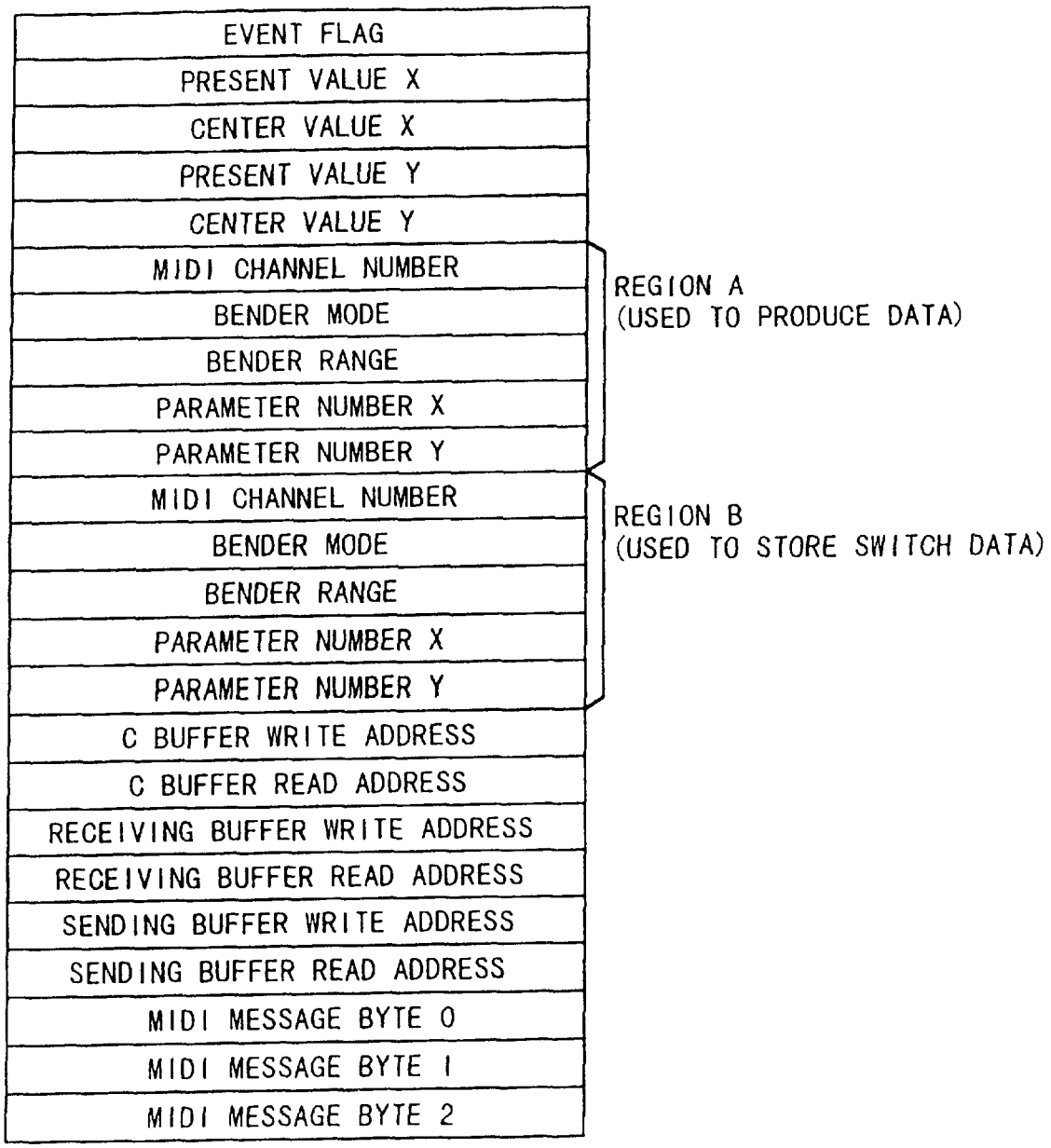
FIG. 4 illustrates an example of a storage region allocation of the RAM shown in FIG. 3.
Figure 7:
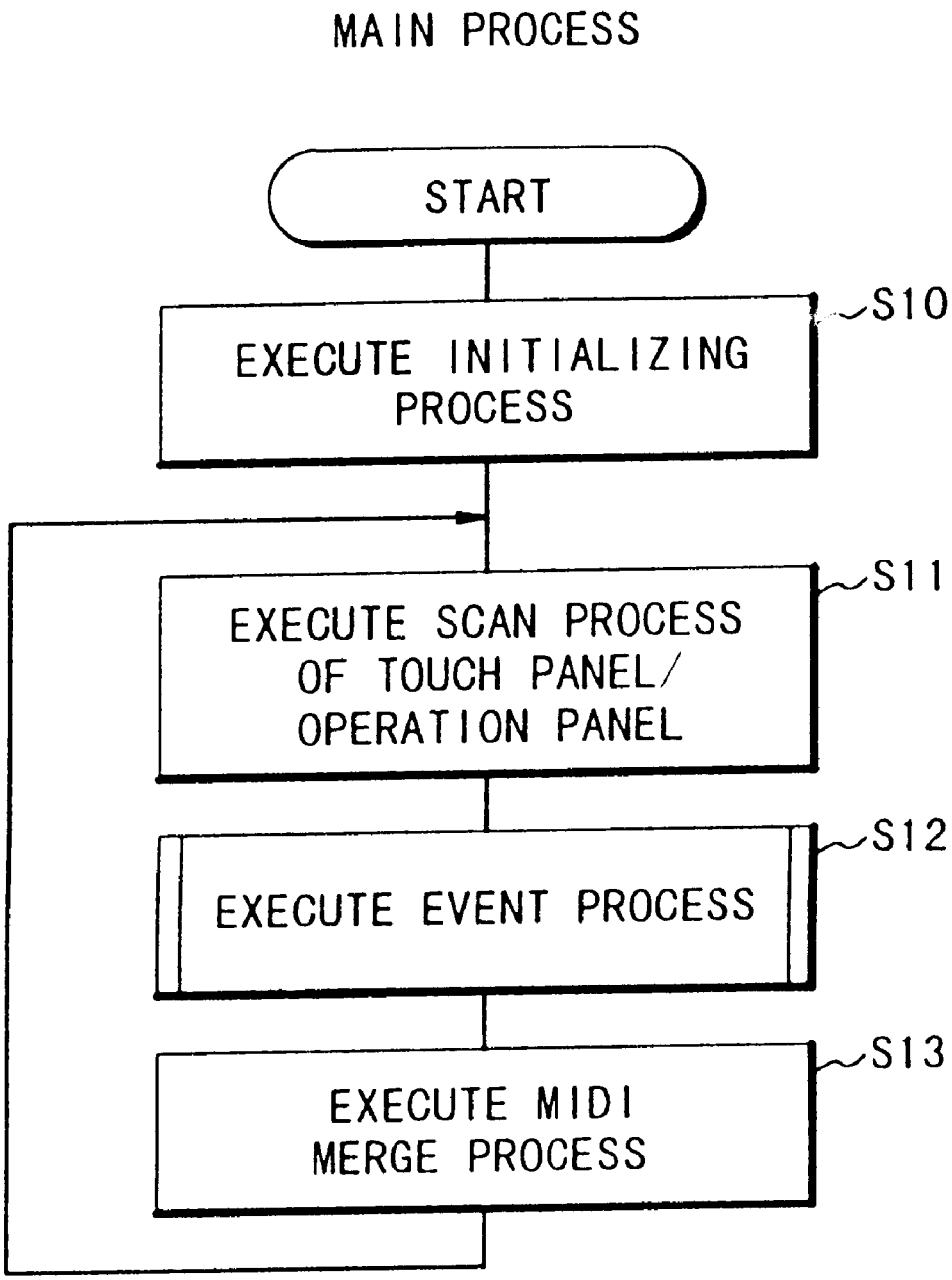
FIG. 7 is a flow chart for describing a operation of an main process executed in the music performance information input apparatus according to the first embodiment of the present invention.

In a random access memory (will be referred to as a "RAM" hereinafter) 22, various sorts of registers, various sorts of flags, various sorts of work regions and the like are provided so as to control the music performance information inputting apparatus. FIG. 4 shows an example of storage region allocations in this RAM 22. In FIG. 4, an event flag is a 1-byte flag for storing events produced by the touch panel 17 and the operation panel 30. Each event corresponds to 1-bit in the event flag. FIG. 5 indicates one example of bit allocations of the event flags. The respective bits are set to "1" when the event occurs.

An event (bit 4) of a touch-on occurs when an operator, for instance, touches the touch panel 17 with his finger. An event (bit 3) of a touch-off occurs when the finger of the operator is released from the touch panel 17. An event (bit 2) of a movement occurs when the finger of the operator is moved while touching his finger to the touch panel 17. An event (bit 1) of a bender range change occurs when the bender range selecting switch 13 is operated. An event (bit 0) of other switch changes occurs when at least one of the MIDI channel selecting switch 12, the X parameter allocating switch 14, the Y parameter allocating switch 15, and the bender mode switch 16 is manipulated.

It should be noted that other registers, flags and work regions provided in the RAM 22 will be explained if necessary.

An MIDI interface 23 corresponds to a sending means and a receiving means according to the present invention. This MIDI interface 23 receives the MIDI messages serially inputted from the MIDI input terminal 18 and converts the received MIDI messages into parallel data. The CPU 20 acquires the MIDI message converted into the parallel data via the system bus 40, and then writes this parallel data into a receiving buffer (not shown in detail) provided in a predetermined region of the RAM 22. A write position within the receiving buffer is designated based on a receiving buffer write address (see FIG. 4) stored in the RAM 22.

Also, the CPU 20 reads out the MIDI message from a sending buffer, and then sends the MIDI message via the system bus 40 to the MIDI interface 23. A read position within the sending buffer is designated based on a sending buffer read address (see FIG. 4) stored in the RAM 22. The MIDI interface 23 converts the MIDI message accepted from the CPU 20 into serial data and thereafter sends this serial data via the MIDI output terminal 19 to an external apparatus.

Next, operations of this music performance information inputting apparatus with the above-described arrangement will now be explained with reference to flow charts indicated in FIG. 7 to FIG. 11. It should be understood that process operations defined in the respective flow charts are carried out under control by the CPU 20.

(1) MAIN PROCESS

When the power supply is turned ON, an initializing process is first executed (step S10). In this initializing process, the hardware inside the CPU 20 is initialized, and initial values are set to the respective regions of the RAM 20.

Subsequently, a scan process of the touch panel 17 and the operation panel 30 is carried out (step S11). In this scan process, the CPU 20 sends out a scan signal to the touch panel 17 and the operation panel 30. In response to this scan signal, the touch panel 17 outputs a coordinate value of the X axis and a coordinate value of the Y axis, which indicate a position of the touch panel 17, where the operator touches his finger. The coordinate value of the X axis is saved in a present value X register defined in the RAM 22, and the coordinate value of the Y axis is saved in a present value Y register defined in the RAM 22 (see FIG. 4).

Also, in response to the above-described scan signal, the operation panel 30 outputs switch data selected, or set by the respective switches 12 to 16. The CPU 20 receives the switch data, and stores them to a region B (used for storing switch data) defined in the RAM 22. That is, the MIDI channel number derived from the MIDI channel selecting switch 12 is set to a MIDI channel register of the region B. The data indicative of the bender range, supplied from the bender range selecting switch 13 is set to a bender range register of the region B. The data derived from the X parameter allocating switch 14 is set to a parameter number X register of the region B. The data derived from the Y parameter allocating switch 15 is set to a parameter number Y register of the region B. The data indicative of the bender mode, derived from the bender mode switch 16 is set to a bender mode register of the region B.

Also, in the step S11, the event flag is set. In other words, in the case that the condition under which the coordinate value is not outputted from the touch panel 17 is changed into the condition under which the coordinate value is outputted from the touch panel 17, the touch-on flag (bit 4) is set. Conversely, when the condition under which the coordinate value is outputted from the touch panel 17 is changed into the condition under which the coordinate value is not outputted, the touch-off flag (bit 3) is set. In the case that the coordinate value outputted from the touch panel 17 is changed, the movement flag (bit 2) is set. When the data indicative of the bender range is changed, which is outputted from the bender range selecting switch 13, the bender range change flag (bit 1) is set. Furthermore, when the MIDI channel number outputted from the MIDI channel selecting switch 12 is changed, when the data outputted from the X parameter allocating switch 14 is changed, when the data outputted from the Y parameter allocating switch 15 is changed, and also when the data outputted from the bender mode switch 16 is changed, the flag (bit 0) of other switch change is set.

When the above-described process operation is complete, an event process is subsequently carried out (step S12). In this event process, a check is made as to whether or not any flag under set state (namely, bit of flag becomes "1") is present in the above-described event flag. If there is the flag under set state, then the process operation corresponding to this flag is carried out. The content of this event process will be discussed later in details.

Next, an MIDI merge process is carried out (step S13). In this MIDI merge process, the MIDI message is read out from the receiving buffer and is merged with another MIDI message which is produced in this music performance information inputting apparatus and is stored in a C buffer defined in the RAM 22, and then the merged MIDI message is written into the sending buffer. A read out position within the receiving buffer is designated by a receiving buffer read address stored in the RAM 22. A readout position within the C buffer is designated by a C buffer read address stored in the RAM 22. A write position within the sending buffer is designated by a sending buffer write address stored in the RAM 22.

When a series of the above-described process operation is accomplished, the sequential operation is returned to the step S11, at which the process operations are similarly repeated. As a result, the process operations are executed in response to operations of the touch panel 17 and the operation panel 30, so that the various sorts of functions of the music performance information inputting apparatus can be realized.

It should be noted that although not shown in the drawing, a serial communication interrupt process is executed in parallel to the above-described main process. That is, upon receipt of the externally supplied MIDI message, the MIDI interface 23 interrupts the execution of the CPU 20. In response to this interrupt, the CPU 20 receives the MIDI message from the MIDI interface 23, and writes it into the receiving buffer as described above. On the other hand, when a process operation for externally transmitting a single MIDI message is completed, the MIDI interface 23 interrupts the execution by the CPU 20. In response to this interrupt, the CPU 20 checks as to whether or not there is at least one MIDI message to be transmitted within the sending buffer. Then, when it is judged that at least one MIDI message to be transmitted is present in the sending buffer, the MIDI message is sent to the MIDI interface 23. The MIDI interface 23 converts the MIDI message into serial data which will then be sent out via the MIDI output terminal 19 to the external apparatus.

(2) EVENT PROCESS

Figure 8:
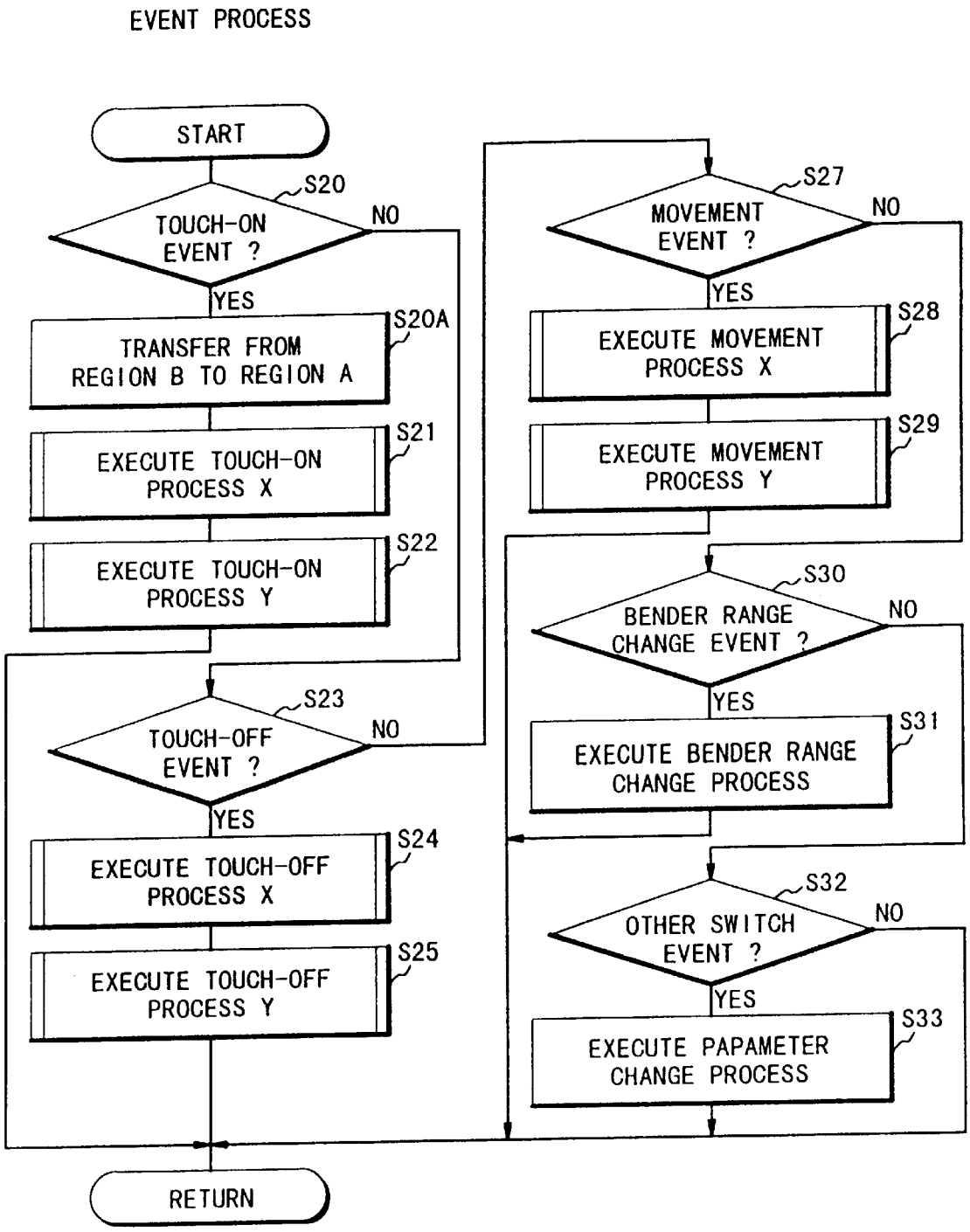
FIG. 8 is a flow chart for describing a detailed operation of an event process indicated in the main process of FIG. 7.
Figure 9:
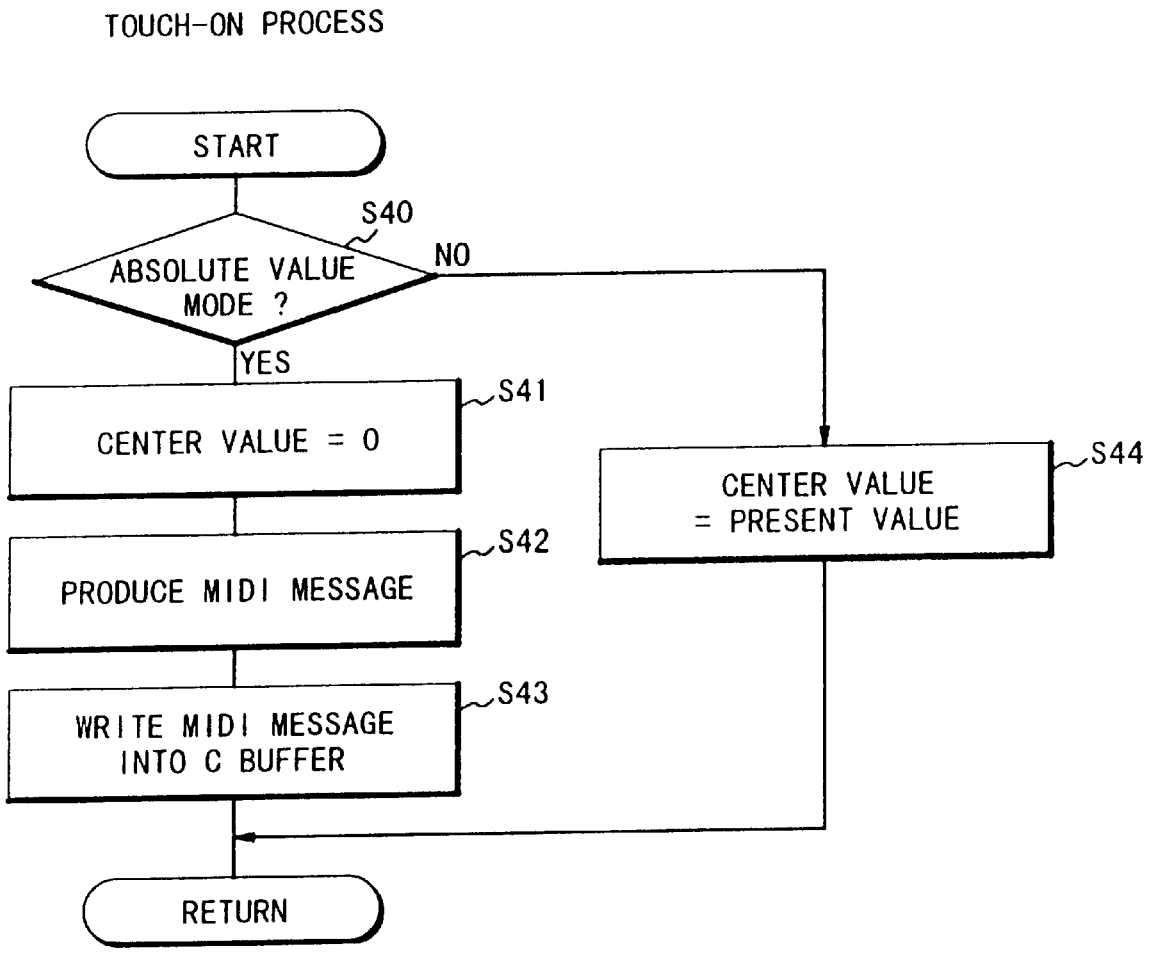
FIG. 9 is a flow chart for describing a detailed operation of a touch-on process shown in FIG. 8.
Figure 10:
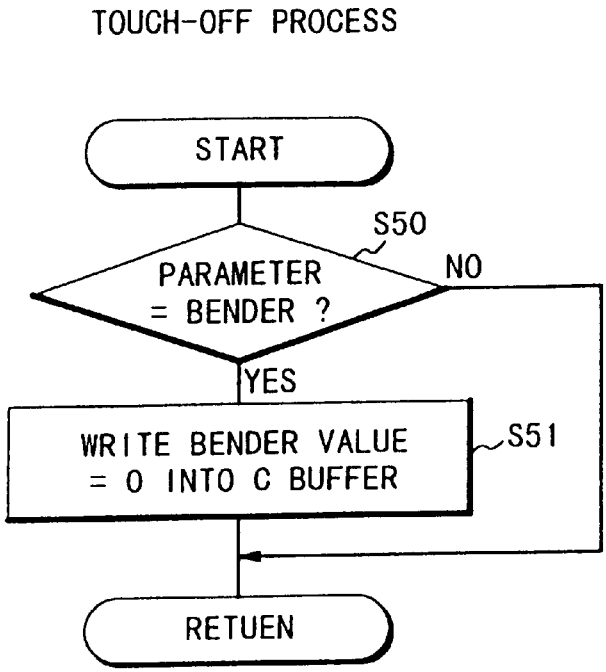
FIG. 10 is a flow chart for describing a detailed operation of a touch-off process shown in FIG. 8.
Figure 11:
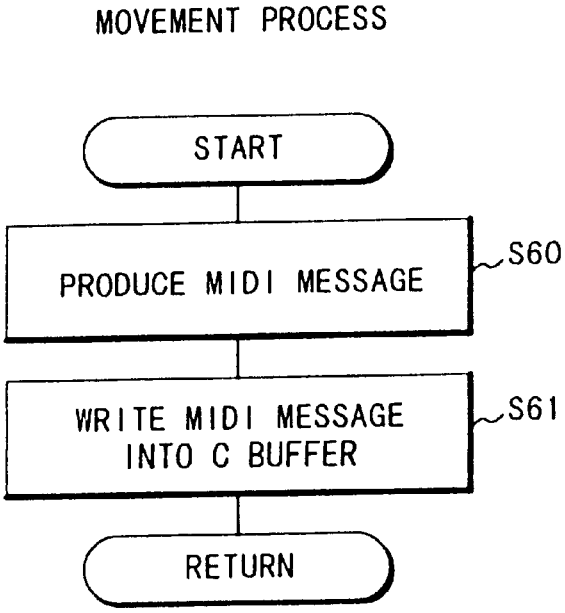
FIG. 11 is a flow chart for describing a detailed operation of a movement process indicated in FIG. 8.

A detailed explanation will now be made of the event process executed at the above-explained step S12 with reference to a flow chart shown in FIG. 8.

In the event process, a check is first done as to whether or not a touch-on event occurs (step S20). This check is carried out by referring to the above-described event flag. A similar judgement is made as to whether or not the following events have occurred. Then, when it is judged that the touch-on event has occurred, the content of the region B of the RAM 22 is transferred to a region A (step S20A). The contents of the region A are held until a next touch-on event happens to occur. Next, a touch-on process according to the X axis is executed (step S21). A detailed operation of this touch-on process is represented in a flow chart of FIG. 9.

2-1) TOUCH-ON PROCESS

In the touch-on process, a check is first made as to whether or not the bender mode corresponds to the absolute value mode (step S40). This check is carried out by referring to the storage content of a bender mode register within the region A defined in the RAM 22. In this case, the same registers as the region B are allocated to the region A of the RAM 22, the data which has been obtained from the operation panel 30 during the previous event process is stored into this region A of the RAM 22. Then, when it is so judged that the bender mode corresponds to the absolute mode, a zero is set as a center value (step S41). In other words, a zero is stored into a center value X register (see FIG. 4) defined in the RAM 22. The center value is used as a base value when the coordinate value is calculated. In the absolute mode, since the center value is set to zero, the data derived from the touch panel 17 is directly used as the coordinate value.

Next, a process to produce an MIDI message is executed (step S42). In this process operation, a parameter number is derived from the parameter number X register within the region A of the RAM 22, and further data corresponding to this parameter number is fetched from the parameter table. Then, the content (zero) of the center value X register is subtracted from the content of the present value X register to calculate a coordinate value of an X axis. Then, the MIDI channel number and the coordinate value are set to the data fetched from the parameter table, so that the complete MIDI message is produced.

For instance, if the parameter derived from the parameter number X register corresponds to the parameter number (="1") for designating the bender, then the first byte data to the fourth byte data of the parameter table are fetched. Then, the lower 4 bits of the first byte data is replaced with the MIDI channel number stored in the MIDI channel register within the region A of the RAM 22. Thereafter, the content (zero) of the center value X register is subtracted from the content of the present value X register, so that a lower byte of a bender value is calculated. The second byte data is replaced with the calculated bender value. In this manner, a part of the MIDI message of the pitch wheel change is produced. It should also be noted that an upper byte of the bender value which becomes the third byte data of the MIDI message is calculated in the touch-on process of the Y axis (step S22 of FIG. 8).

Next, a first byte and a second byte of the MIDI message formed at the above-described step S42 is written into a C buffer (step S43). This C buffer is a work buffer provided at a predetermined region of the RAM 22. The write position in the C buffer is designated by a C buffer write address (see FIG. 4) stored in the RAM 22. Thereafter, the sequence operation is returned from this touch-on process routine to the event process routine.

When it is judged at the above step S40 that the bender mode is not the absolute value mode, the content of the present value X register is set to the center value X register (see FIG. 4) of the RAM 22 as a center value (step S44). As a result, a coordinate value is subsequently obtained as a relative value to the content of the center value X register in a movement process X (step S28) to be described later. Thereafter, the sequence operation is returned from this touch-on process routine to the event process routine.

In the event process routine, a touch-on process of the Y axis is carried out (step S22). The content of this touch-on process is the same as the above-described process operation defined at the step S21 except that the coordinate value of the Y axis is handled instead of the coordinate value of the X axis. When the above-explained MIDI message of the pitch wheel change is produced, an upper byte of the bender value which becomes the third byte data of the MIDI message is generated by executing this touch-on process of the Y axis. Thereafter, the sequence operation is returned from this event process routine to the main process routine. It should be understood that when the MIDI message does not require the touch-on process of the Y axis, this process operation defined at the step S22 is skipped.

When it is judged at the step S20 in the event process routine that no touch-on event occurs, another check is made as to whether or not a touch-off event occurs (step S23). When it is judged that the touch-off event occurs, the touch-off process of the X axis is carried out (step S24). A detailed operation of this touch-off process is shown in a flow chart of FIG. 10.

2-2) TOUCH-OFF PROCESS

In the touch-off process, a check is first done as to whether or not the parameter number stored in the parameter number register X and Y corresponds to such a parameter number for instructing a bender (step S50). Then, when it is judged that this parameter number corresponds to the parameter number for instructing the bender, the second byte of the MIDI message which has been processed in the touch-on process and stored into the C buffer is set to zero (step S51). As a consequence, no pitch change is made in the subsequent tone generation. Thereafter, the sequence operation is returned from this touch-off process routine to the event process routine. Also, when it is so judged at the above step S50 that the parameter number does not correspond to the parameter number for instructing the bender, the sequence operation is returned from this touch-off process routine to the event process routine.

In the event process routine, a touch-off process of the Y axis is subsequently carried out (step S25). The content of this Y-axis touch-off process is the same as that of the above-described step S24 except that the third byte of the MIDI message in the C buffer is handled. Thereafter, the sequence operation is returned from this event process routine to the main process routine.

At the above-explained step S23, when it is judged that no touch-off event occurs, another check is subsequently done as to whether or not a movement event occurs (step S27). Then, if it is so judged that the movement event occurs, then a movement process of the X axis is carried out (step S28). A detailed operation of this movement process is indicated in a flow chart of FIG. 11.

2-3) MOVEMENT PROCESS

First, in the movement process of the X axis, a process for producing an MIDI message is carried out (step S60). Next, another process is performed that the processed MIDI message is written into the C buffer (step S61). These processes are identical to those defined at the above-explained steps S42 and S43. Thereafter, the sequence operation is returned from this movement process routine to the event process routine.

In the event process routine, a movement process for the Y axis is carried out (step S29). The content of this Y-axis movement process is the same as the process defined at the step S28 except that the coordinate value of the Y axis is handled instead of the coordinate value of the X axis. Then, the sequence operation is returned from the event process routine to the main routine.

When it is judged at the above step S27 that no movement event occurs, another check is subsequently performed as to whether or not a bender range change event occurs (step S30). Then, if a judgement is made that the bender range change event occurs, then a bender range change process is performed (step S31). In this bender range change process, the below-mentioned MIDI messages are produced and then are set to the C buffer:

(1) Bn6400

(2) Bn6500

(3) Bn06XX

[(4) Bn26YY]

In these MIDI messages, the MIDI messages (1) and (2) correspond to messages for designating the parameter numbers of the bender range. The MIDI message (3) corresponds to a message for sending data XX used to define the bender range. This data XX is utilized as, for instance, "X100" cent. It should be understood that when the bender range is controlled in unit of cent, the MIDI message (4) is furthermore produced. In this case, the data YY is used as "X1" cent. Subsequently, the sequence operation is returned from this event process routine to the main process routine.

When it is judged at the above step S30 that no bender range change event occurs, a further check is made as to whether or not an event of other switches occurs (step S32). Then, if it is so judged that the event of other switches occurs, then a parameter change process is performed (step S33). In this parameter change process, the content of the region B of the RAM 22 is changed according to ON/OFF states of the switches on the operation panel 30. Subsequently, the sequence operation is returned from this event process routine to the main process routine. Even when it is judged at the step S32 that no event of other switches occur, the sequence operation is returned from this event process routine to the main process routine.

Although the touch panel 17 has been constituted to output the coordinate values of the X axis and Y axis in the above-described first embodiment, this touch panel 17 may be alternatively arranged to output a coordinate value of a Z axis in addition to these X- and Y-axis coordinate values. In this alternative case, depression force of the touch panel 17 is detected, and this pressure value may be used as the coordinate value of the Z axis. According to this arrangement, three sorts of music performance information may be produced at the same time by one touch operation.

OVERVIEW OF SECOND MUSIC PERFORMANCE INFORMATION INPUTTING APPARATUS

Now, a description will be made of a second embodiment of the present invention. That is, in accordance with the second embodiment, a music performance information inputting apparatus is assembled into an electronic musical instrument. It should be noted that it is possible to constitute this music performance information inputting apparatus as an independent apparatus. It is now assumed that two pieces of music performance information have been allocated to each of an X axis, a Y axis, and a Z axis in the second embodiment.

Figure 12:
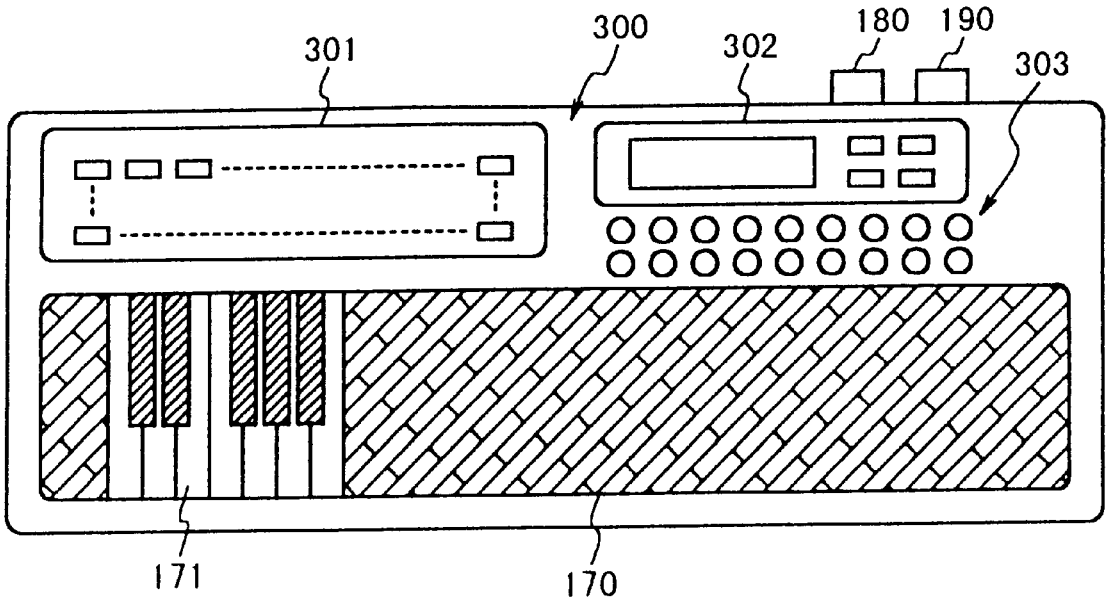
FIG. 12 is an outer view for representing an electronic musical instrument, as viewed from an upper surface thereof and partially cut out, according to a second embodiment of the present invention.

FIG. 12 is an outer view for representing an electronic musical instrument into which a music performance information inputting apparatus has been assembled, a portion of which is cut away, as viewed from an upper surface thereof. This electronic musical instrument contains a touch panel 170, a picture of a keyboard 171, an operation panel 300, an external input terminal 180, and an external output terminal 190.

The touch panel 170 may detect depression force exerted by touch operation and may output this force detection value as a coordinate value of the Z axis (namely, front/rear direction in FIG. 12) in addition to the above-described function of the touch panel 17 shown in the first embodiment. Various types of touch panels such as an analog type touch panel and a digital type touch panel and other types of touch panels well known in the field may be employed as this touch panel 170. It should be noted that in such an application case without using a Z coordinate value, this touch panel 170 may be replaced by the above-described touch panel 17 of the first embodiment.

The picture of the keyboard 171 may be directly drawn on the touch panel 170. Also, this keyboard picture 171 may be constructed of, for instance, a plastic film on which a plurality of keys are drawn. In this case, the plastic film is fixed on the touch panel 170. It should also be noted that although only the keyboard picture 171 is partially drawn, this keyboard picture 171 is practically drawn over the entire surface of the touch panel 170.

On the operation panel 300, a timbre control switch group 301, a display device 302, and a timbre selecting switch group 303 are provided. The timbre control switch group 301 is arranged by a plurality of switches for producing timbre. The display device 302 is arranged by, for example, LEDs (light emitting diodes), or an LCD (liquid crystal display) device and a switch group for controlling a display content of these LEDs and LCD device. The timbre selecting switch group 303 is arranged by a plurality of switches. The timbre produced by using the timbre switch group 301 by an operator is allocated to the respective switches contained in this timbre selecting switch group 303. Under such a condition that no timbre is produced, default timbre has been allocated to the respective switches. An operator player depresses any switch of the timbre selecting switch group 303, so that desirable timbre can be selected by one touch operation.

The external input terminal 180 corresponds to a terminal for inputting music performance information produced from an external apparatus into this electronic musical instrument. The music performance information received by this external input terminal 180 is acquired inside the electronic musical instrument. The external output terminal 190 is employed so as to externally output the music performance information produced in the electronic musical instrument. To this external output terminal 190, for instance, a tone generating unit may be connected. As a result, musical tones can be produced based upon the music performance information outputted from the electronic musical instrument.

ARRANGEMENT OF ELECTRONIC MUSICAL INSTRUMENT

Figure 13:
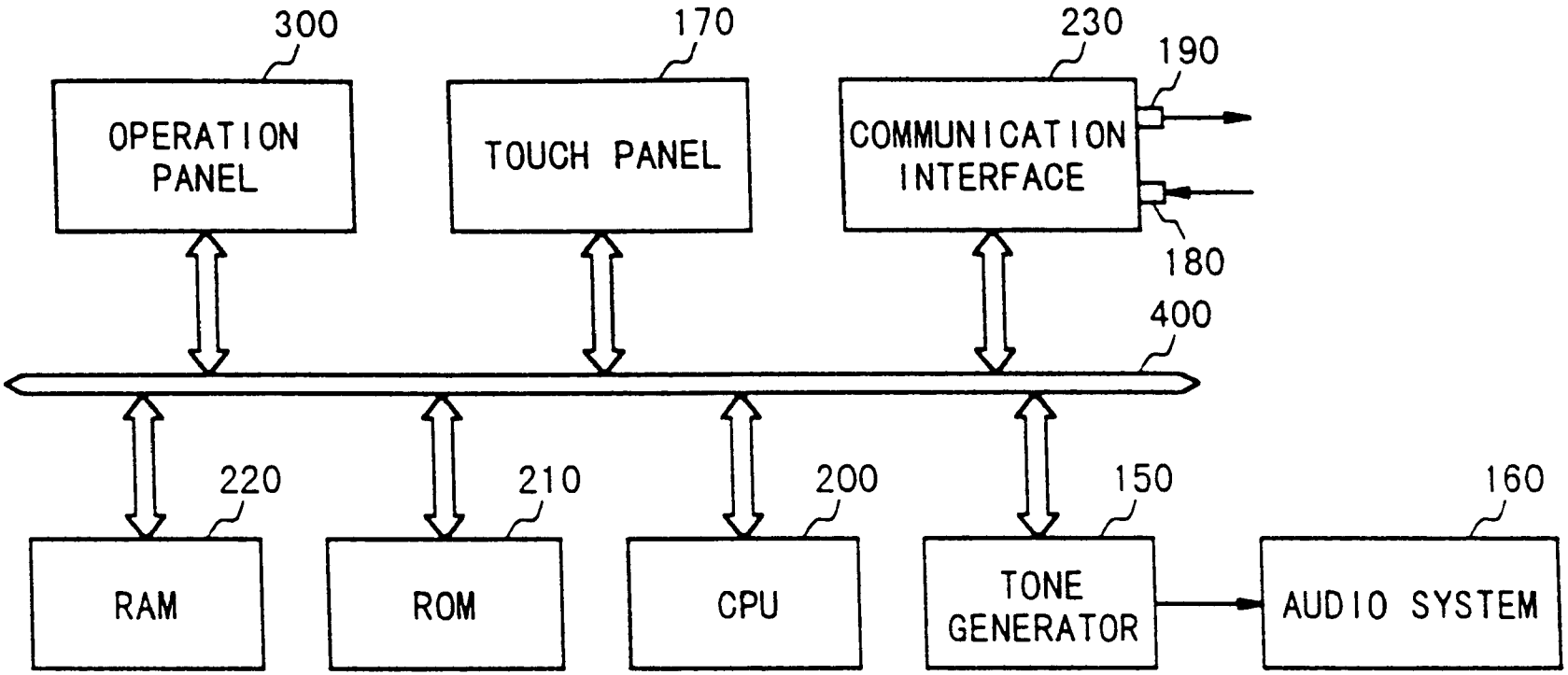
FIG. 13 is a schematic block diagram for representing an arrangement of the electronic musical instrument according to the second embodiment of the present invention.
Figure 14:
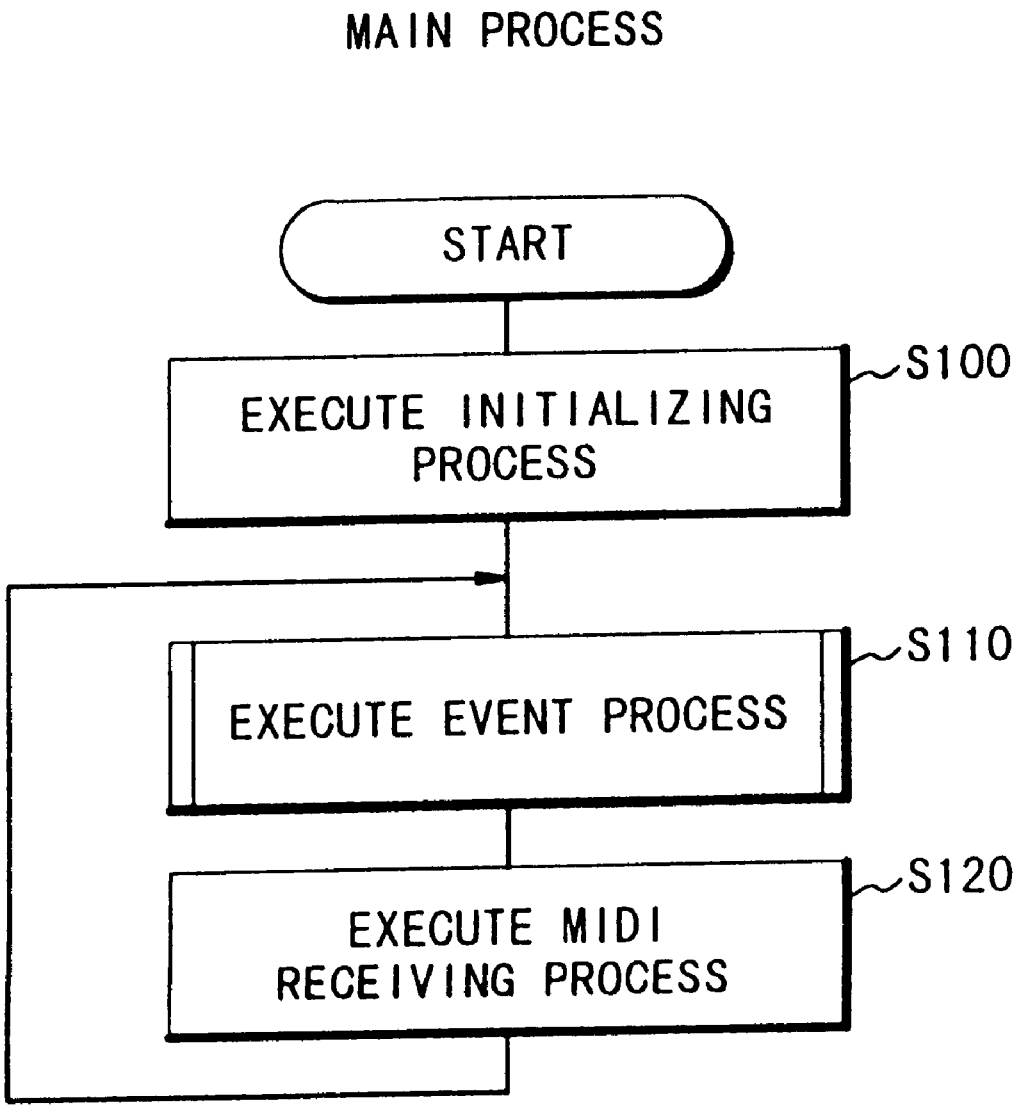
FIG. 14 is a flow chart for indicating a operation of an main process executed in the electronic musical instrument according to a second embodiment of the present invention.

Referring now to a block diagram of FIG. 13, an electric arrangement of this electronic musical instrument will be described in detail.

A CPU 200 sequentially reads out control programs previously stored in a ROM 210 via a system bus 400 and then sequentially executes the read control programs. Thereby, various circuit elements of the electronic musical instrument are controlled. In addition to the control programs, various fixture data are stored in the above-described ROM 210.

Various sorts of registers, various sorts of flags, and various work regions, which are used to control this electronic musical instrument, are provided in a RAM 220. A major flag and register used in the second embodiment will now be described.

1). EVENT FLAG

An event flag used in the second embodiment is employed which is similar to the 1-byte flag of the first embodiment. The events stored in this event flag contain a touch-on event, a touch-off event, a movement event, and switch events.

2). TOUCH FLAG

A touch flag is used to store a condition as to whether or not the touch panel 170 is touched.

3). X-REGISTER, Y-REGISTER, Z-REGISTER

Registers are used to store coordinate values about the X-axis, Y-axis, and Z-axis.

4). MOVEMENT X-FLAG, MOVEMENT Y-FLAG, MOVEMENT Z-FLAG

Flags are employed to store a condition as to whether or not the respective coordinate values of the X axis, Y axis, and Z axis are changed.

5). MODE FLAG

A mode flag is used to store a condition as to whether a coordinate value derived from the touch panel 170 is directly used as an absolute value, or as a relative value to a value derived from a first touch position.

6). REFERENCE PITCH VALUE REGISTER

A register is employed to store a present pitch value.

7). X-REFERENCE COORDINATE VALUE REGISTER, Y-REFERENCE COORDINATE VALUE REGISTER

Registers are used to store present coordinate values of the X axis and the Y axis.

It should be noted that other registers, flags and work regions provided in the RAM 220 will be explained, if necessary.

As previously described, the touch panel 170 outputs the respective coordinate values of positions touched by a finger in the X axis, Y axis, and Z axis. The CPU 200 detects as to whether or not the touch operation is carried out, where the touched position is located, what the touch depression force is exerted, and whether or not the touched position is moved based upon the coordinate values derived from the touch panel 170. Then, this CPU 200 executes a process operation for producing music performance information in response to this detection result.

A tone generator 150 generates a musical tone signal in response to an instruction from the CPU 200. The musical tone signal is supplied to an audio system 160. The audio system 160 is arranged by an amplifier and a loud speaker and so on, and further converts the musical tone signal into musical tones.

A communication interface 230 corresponds to a transmitting means of the present invention. This communication interface 230 receives serial data inputted from the external input terminal 180 and converts this serial data into parallel data. The CPU 200 acquires this parallel data as a music performance information via the system bus 400, and then writes the acquired music performance information into a receiving buffer provided in a predetermined region of the RAM 220.

Also the CPU 200 reads out music performance information from a transmitting buffer provided in a predetermined region of the RAM 220, and then transmits this read music performance information to the communication interface 230 via the system bus 400. The communication interface 230 converts the music performance information received from the CPU 200 into serial data, and then externally transmits this serial data from the external output terminal 190.

As the above-described communication interface 230, for instance, an MIDI interface may be employed. It should be noted that although this MIDI interface is employed as the communication interface 230 in the following description, not only the MIDI interface but also various other interfaces may be utilized such as an RS232C interface, an SCSI interface, and an interface specific to a pattern of an electronic musical instrument.

A timer (not shown in detail) is provided in this electronic musical instrument. This timer generates an interrupt signal in a preselected time period. In synchronism with this interrupt signal, the CPU 200 scans the touch panel 170 and the operation panel 300.

OPERATIONS OF ELECTRONIC MUSICAL INSTRUMENT

Referring now to flow charts indicated in FIG. 14 through FIG. 21, operations of this electronic musical instrument according to the second embodiment will be explained more in detail. The process operations defined in the respective flow charts are executed by the CPU 200 in accordance with the control program stored in the ROM 210. It should be noted that the following description is mainly related to the music performance information inputting function.

(1) MAIN PROCESS

When the power supply is turned ON, an initializing process is first carried out (step S100). Subsequently, an event process is carried out (step S110). In this event process, a judgement is made as to whether or not there is a flag being ON state within the above-described event flag. When it is judged that there is such a flag being ON state, a process operation corresponding to the flag is executed. A detailed operation of this event process will be explained later.

Next, an MIDI receiving process is carried out (step S120). In this MIDI receiving process, an MIDI message received by the external input terminal 180 of the communication interface 230 is interpreted, and the interpreted MIDI message is converted into an event. As a result, this electronic musical instrument can be controlled by the external apparatus.

When a series of the above-explained process operations is completed, the sequence operation is returned to the previous step S110, and then the above-described process operations are repeatedly carried out. As a consequence, the process operations corresponding to the manipulations of the touch panel 170 and the operation panel 300 are carried out, so that various functions as the electronic musical electronic instrument can be realized.

Although a not shown in this flow chart, a serial communication interrupt process is performed in parallel to the above-explained main process. This serial communication interrupt process is the same as that of the first embodiment.

(2) TIMER INTERRUPT PROCESS

Figure 15:
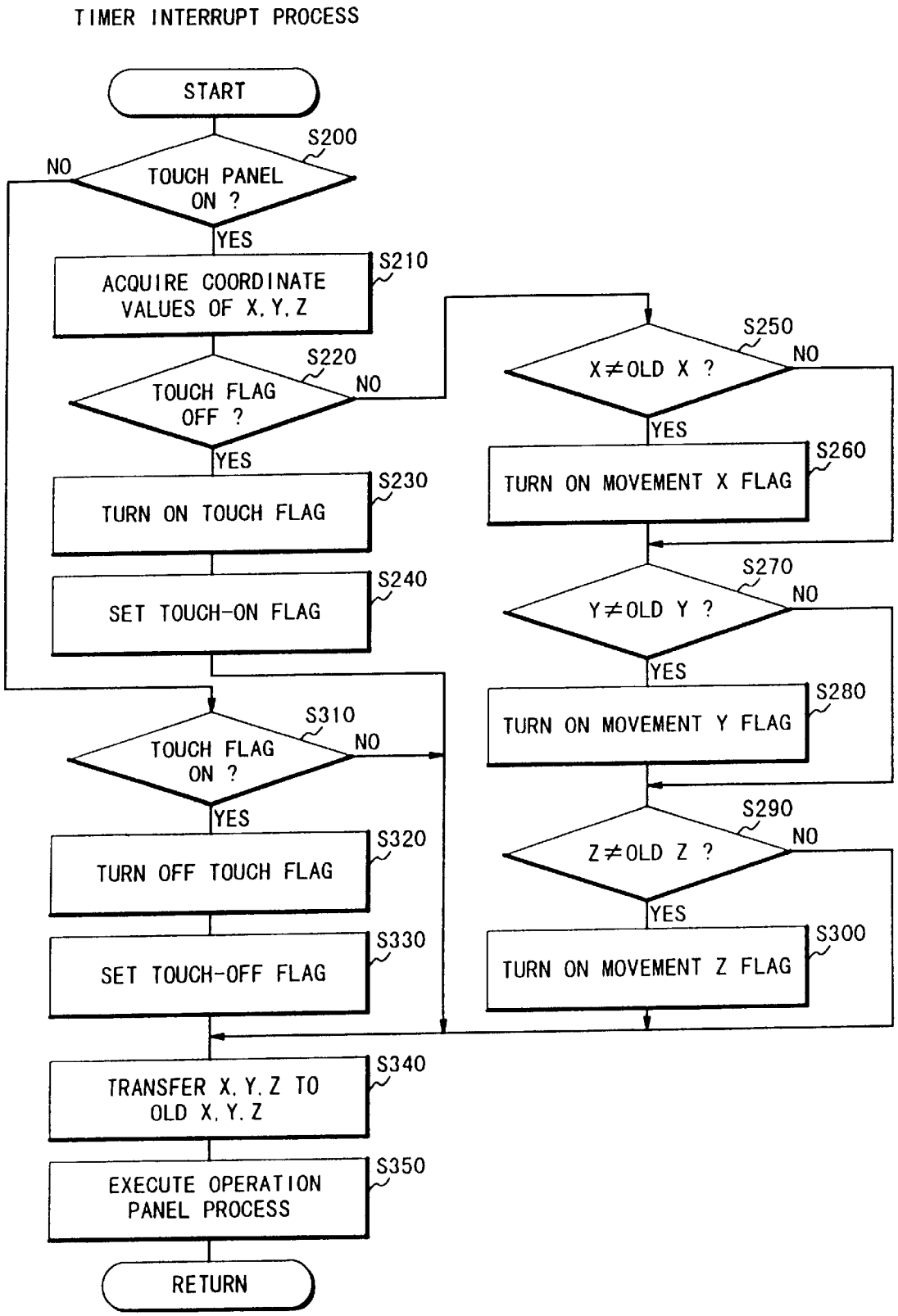
FIG. 15 is a flow chart for explaining a timer interrupt process executed in the electronic musical instrument according to the second embodiment of the present invention.

Then, a timer interrupt process will now be explained with reference to a flow chart of FIG. 15. This timer interrupt process routine is initiated every preselected time period in response to the interrupt signal issued from the timer. In this timer interrupt process, the touch panel 170 and the operation panel 300 are scanned. As a consequence, the scan operation of the touch panel 170 and the operation panel 300 are carried out in parallel to the above-described main process operation.

Upon receipt of the interrupt signal, the timer interrupt process starts and the CPU 200 firstly checks as to whether or not the touch panel 170 is turned ON (step S200). That is, the CPU 200 sends out a scan signal to the touch panel 170 and the operation panel 300. In response to this scan signal, when the touch panel 170 is turned ON, this touch panel 170 outputs an coordinate value of an X axis, a coordinate value of a Y axis, and a coordinate value of a Z axis, which indicate a touched position of this touch panel 170. To the contrary, when the touch panel 170 is not turned ON, the CPU 200 outputs a zero value. Thus, the CPU 200 may judge as to whether or not the touch panel 170 is touched by the finger of the player by checking as to whether or not the effective coordinate value is outputted from the touch panel 170.

In this case, when it is judged that the touch panel 170 is turned ON, the respective coordinate values of the X axis, the Y axis, and the Z axis are acquired (step S210). Then, a check is done as to whether or not the touch flag is turned OFF (step S220). Now, when it is so judged that the touch flag is turned OFF, the CPU 200 recognizes that although no finger touch was made on the touch panel 170 during the previous scanning operation, the touch panel 170 is touched by this finger during the present scanning operation, and thus turns ON the touch flag (step 230). Then, the touch-on flag is set (step 240). Subsequently, the sequence operation is advanced to a step 340.

When it is judged at the step 220 that the touch flag is not turned OFF, the CPU 200 recognizes that the finger touch was made on the touch panel 170 during the previous scanning operation, and the touch panel 170 is touched by this finger during the present scanning operation, and another check is done as to whether or not the touch position is moved (steps S250 to S300). That is, a first check is done as to whether or not the previously acquired coordinate value of the X axis (namely, old X) is coincident with the presently acquired coordinate value of the X axis (namely, X) (step S250). Then, when it is judged that the old X is not coincident with the X, the CPU 200 may judge that the touched position is moved along the X axis direction, and thus turns ON a movement X-flag (step S260). Conversely, when the old X is coincident with the X, the time interrupt process operation skips this step 260.

Subsequently, a further check is made as to whether the previously acquired coordinate value of the Y axis (namely, old Y) is coincident with the presently acquired coordinate value of the Y axis (namely, Y) (step S270). Then, when it is judged that the old Y is not coincident with the Y, the CPU 200 may judge that the touched position is moved along the Y axis direction, and thus turns ON a movement Y flag (step S280). Conversely, when the old Y is coincident with the Y, the timer interrupt process operation skips this step 280. Next, another check is made as to whether or not the previously acquired coordinate value of the Z axis (namely, old Z) is coincident with the presently acquired coordinate value of the Z axis (namely, Z) (step S290). Then, when it is judged that the old Z is not coincident with the Z, the CPU 200 may judge that the touched depression force along the X axis direction is changed, and thus turns ON the movement Z flag (step S300). Conversely, when the old Z is coincident with the Z, the timer interrupt process operation skips this step 300. Thereafter, this process operation is branched to a step S340.

When it is judged at the step S200 that the touch panel 170 is not turned ON, a check is done as to whether or not the touch flag is turned ON (step S310). In this case, when it is judged that the touch flag is turned ON, the CPU 200 recognizes that although the touch panel 170 was touched during the previous scanning operation, the touch panel 170 is not touched during the present scanning operation, and thus turns OFF the touch flag (step S320). Then, the touch-off flag is set (step S330). Subsequently, the process operation is advanced to a step S340. When it is judged that the touch flag is not turned ON at the above step S310, the CPU 200 judges that the touch panel 170 was not and is not touched during the previous scanning operation and the present scanning operation, respectively, and the process operation skips the steps S320 and S330.

At a step S340, the respective coordinate values of the X axis, the Y axis, and the Z axis, which have been acquired at the step S210, are stored into the X register, the Y register, and the Z register, respectively. The storage contents of these X register, Y register, and Z register are referred in the next timer interrupt process.

The above-described process operations are those for the touch panel 170. When these process operations for the touch panel 170 are accomplished, an operation panel process is subsequently performed (step S350). In this operation panel process, a check is done as to whether or not the respective switches mounted on the operation panel 300 are manipulated. When it is judged that each of the switches is manipulated, an event flag corresponding to the manipulated switch is set. Thereafter, the sequence operation is returned from this timer interrupt process routine to the interrupted position.

(3) EVENT PROCESS

Figure 16:
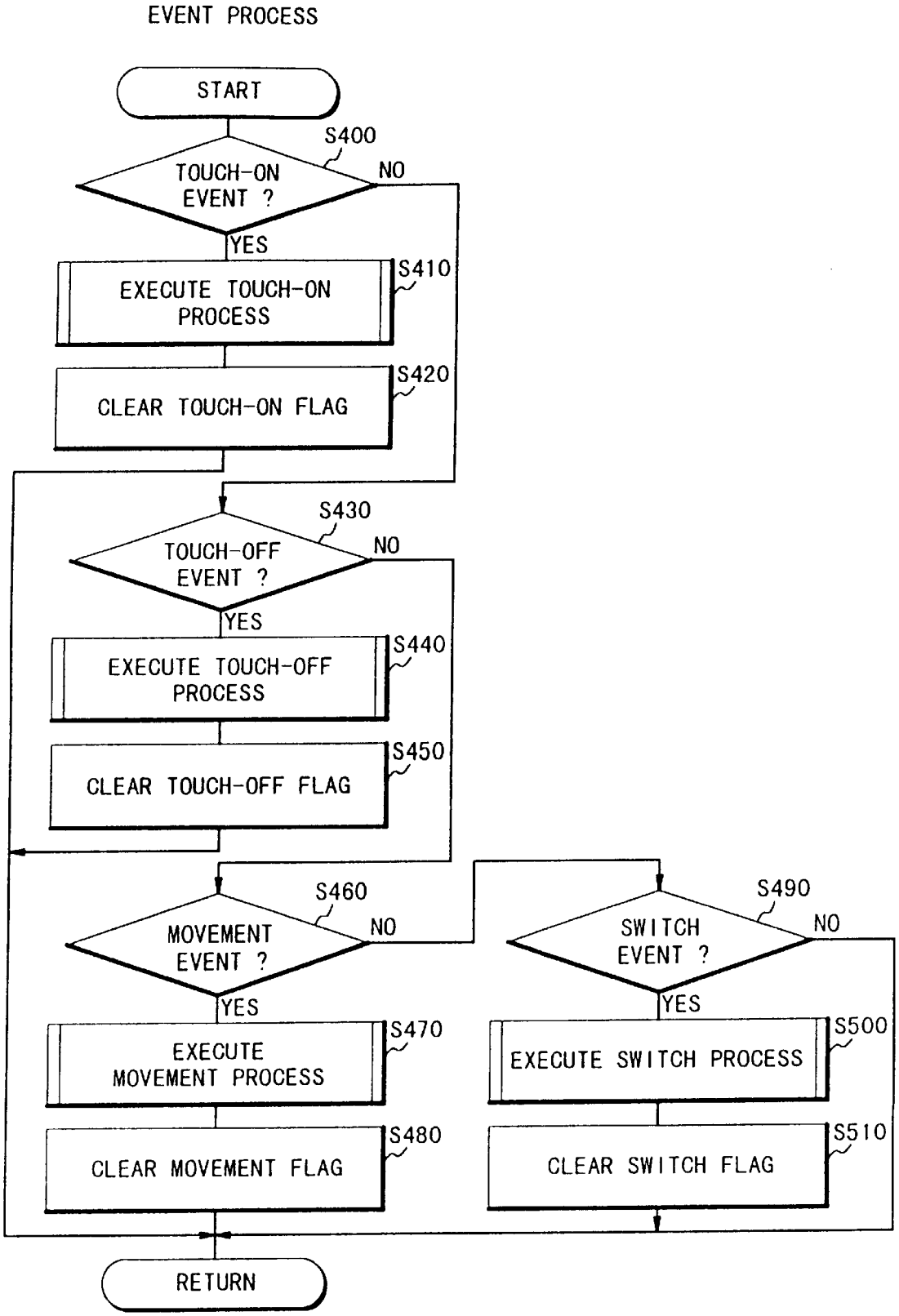
FIG. 16 is a flow chart for describing a detailed operation of an event process indicated in the main process of FIG. 14.
Figure 17:
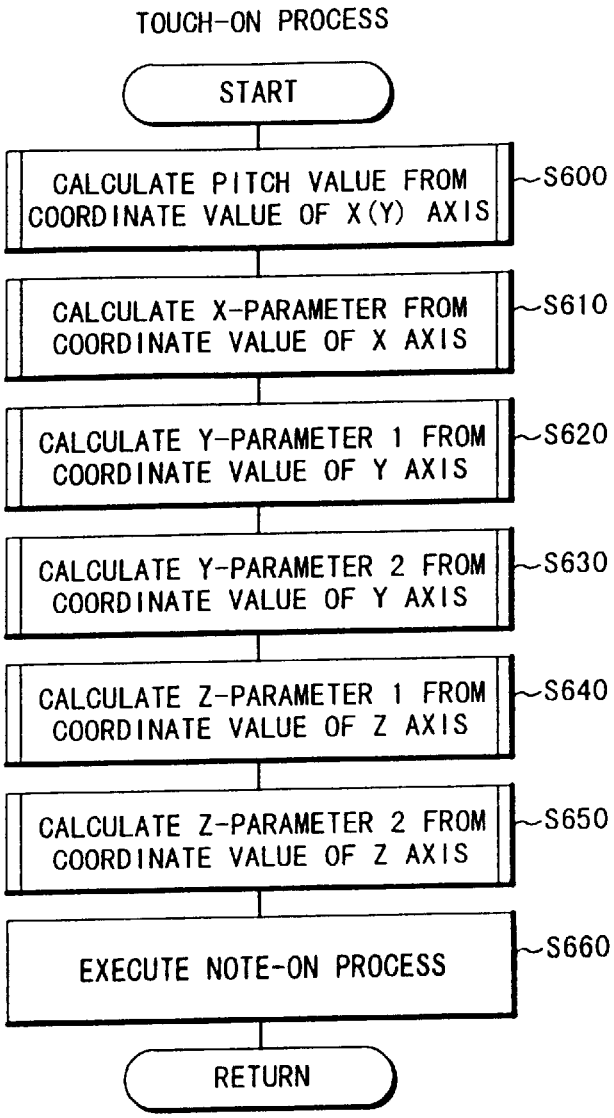
FIG. 17 is a flow chart for describing a detailed operation of a touch-on process shown in FIG. 16.
Figure 18:
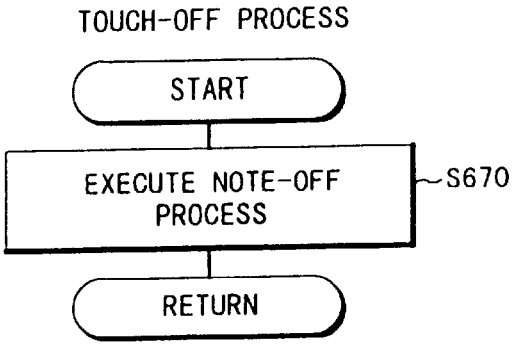
FIG. 18 is a flow chart for describing a detailed operation of a touch-off process shown in FIG. 16.
Figure 19:
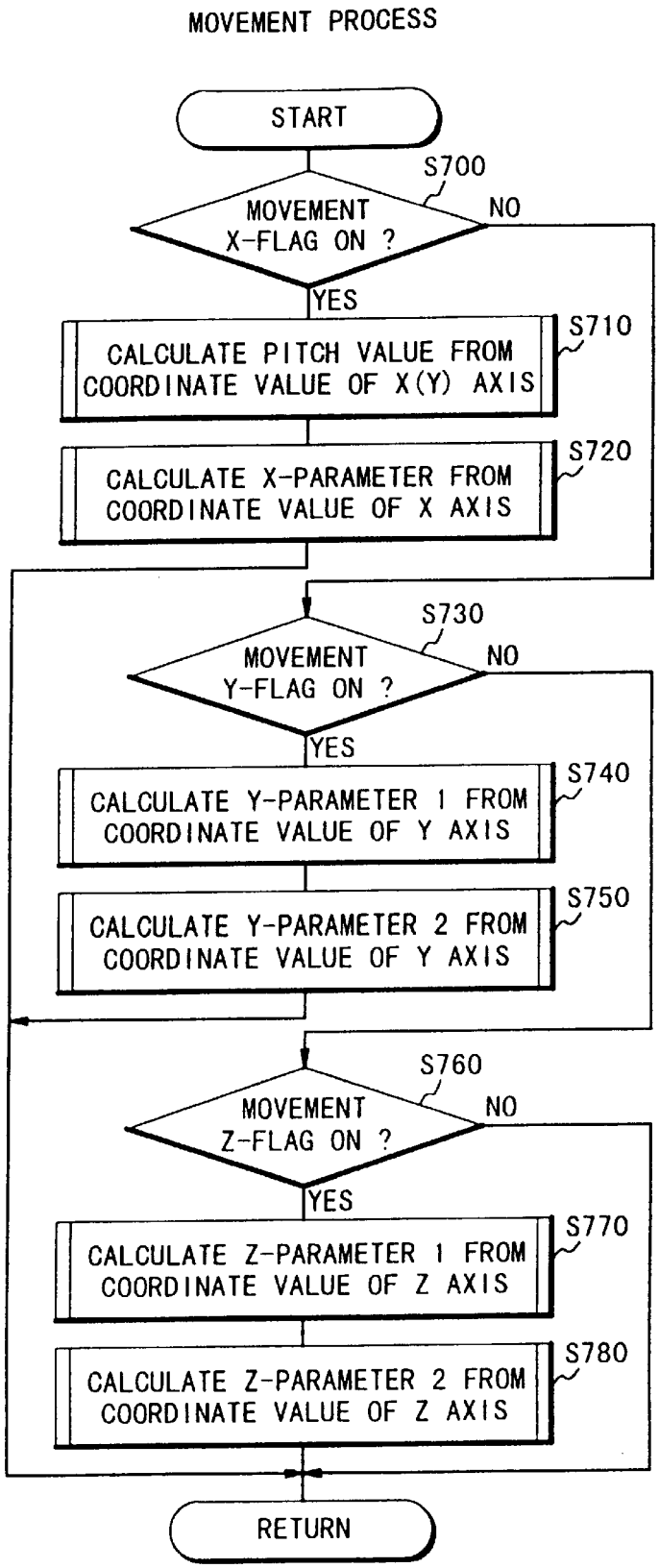
FIG. 19 is a flow chart for describing a detailed operation of a movement process indicated in FIG. 16.
Figure 20:
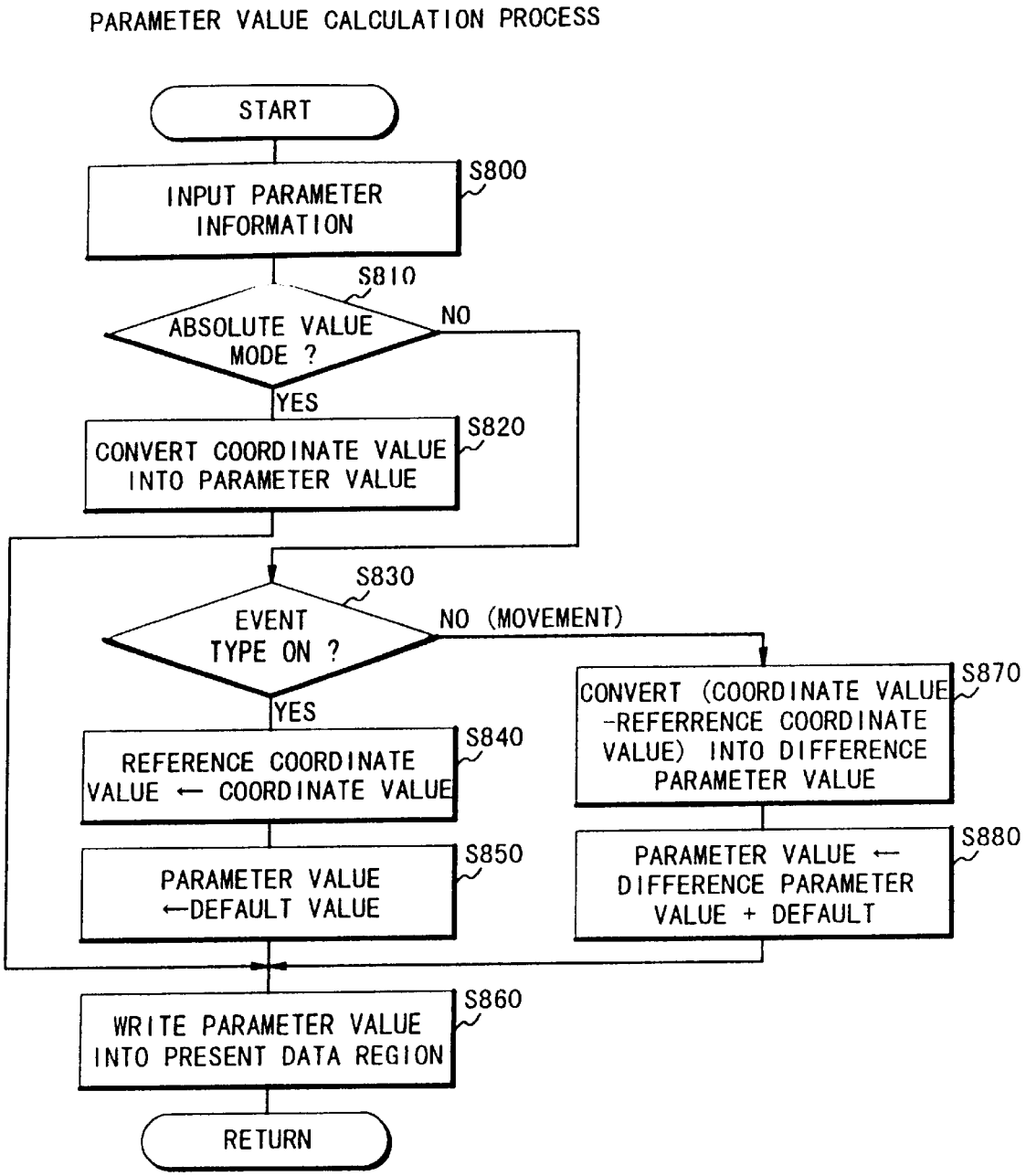
FIG. 20 is a flow chart for describing a detailed operation of a parameter value calculation process shown in FIG. 17 and FIG. 19.
Figure 21:
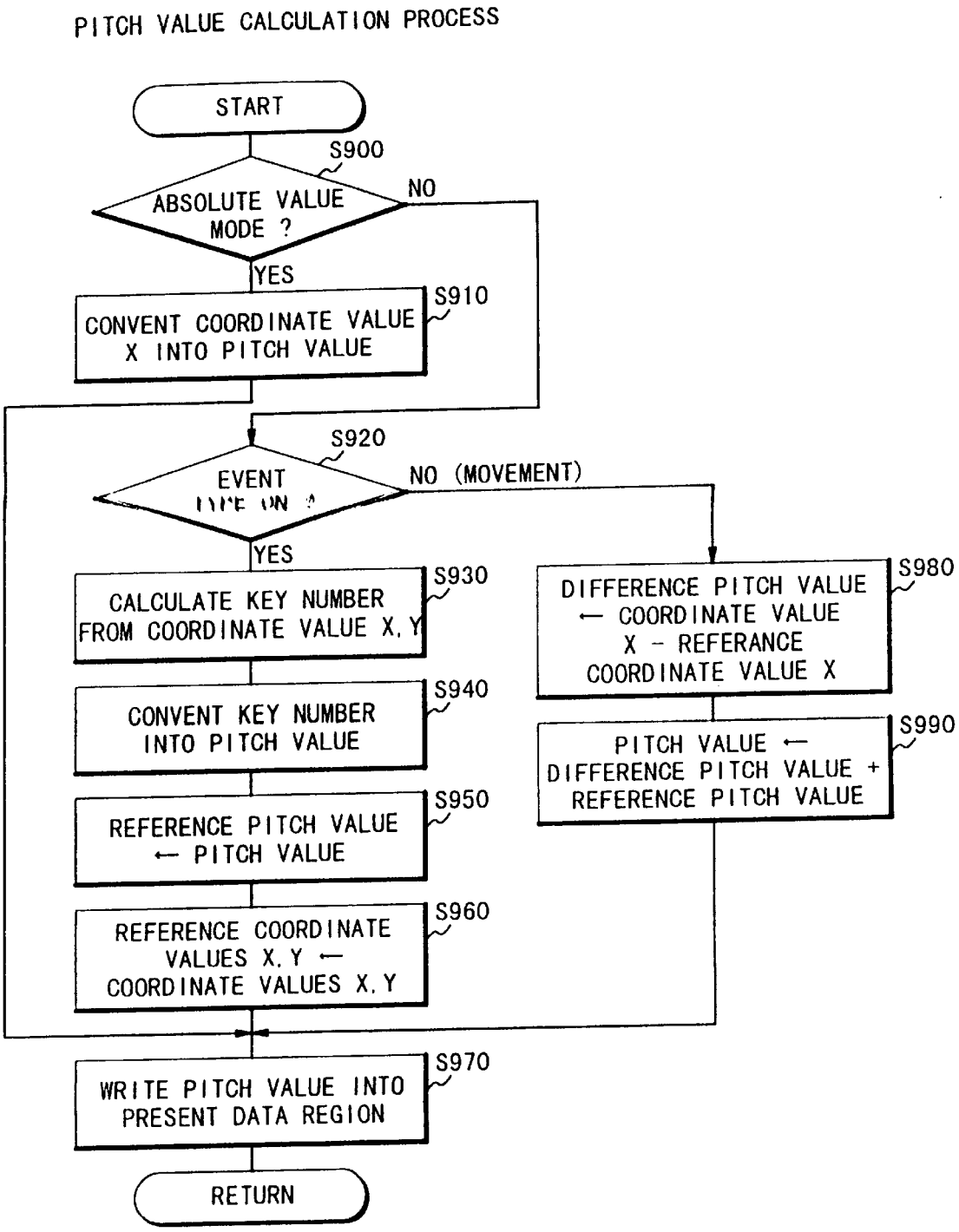
FIG. 21 is a flow chart for explaining a detailed operation of a pitch value calculation process indicated in FIG. 17 and FIG. 19.

A detailed explanation will now be made of the event process executed at the above-explained step S110 of the main process routine with reference to a flow chart shown in FIG. 16.

In the event process, a check is first done as to whether or not a touch-on event occurs (step S400). This check is carried out by referring to the above-described event flag. A similar judgement is made as to whether or not the following events have occurred. Then, when it is judged that the touch-on event has occurred, a touch-on process is executed (step S410). A detailed operation of this touch-on process is represented in a flow chart of FIG. 17.

3-1) TOUCH-ON PROCESS

In this touch-on process, a pitch value calculation process is first carried out based upon the coordinate value of the X(Y) axis (step S600). In this flow chart of FIG. 17, symbol "(Y)" indicates that a pitch value may be calculated based upon the coordinate value allocated not only to the X axis, but also to the Y axis. This allocation is similar to the below-mentioned process. A detailed content of this pitch value calculation process operation is described in a flow chart of FIG. 21.

3-1-1) PITCH VALUE CALCULATION PROCESS

In the pitch value calculation process, a check is first made as to whether or not the present mode is the absolute value mode (step S900). This check is carried out by investigating a mode flag of the RAM 220. Then, when it is judged that the present mode corresponds to the absolute value mode, the coordinate value of the X axis is converted into a pitch value (step S910). Thereafter, the process operation is branched to a step S970.

On the other hand, when it is judged at the above-described step S900 that the present mode is not equal to the absolute value mode, a check is done as to whether or not the event type is turned ON, namely the process operation for the touch-on process is presently executed (step S920). Then, when it is judged that the event type is turned ON, namely the process operation for the touch-on process is presently carried out, a key number is calculated based on the respective coordinate values of the X axis and the Y axis (step S930). In other words, a key number of a key corresponding to the touched position specified by the respective coordinate values of the X axis and the Y axis is calculated. In this case, since each key has a predetermined area, a player may touch anywhere on the predetermined area. Next, the calculated key number is converted into pitch value (step S940). As a consequence, in such a case that the touch-on event happens to occur, namely the touch panel 170 is first touched, even when any position of one key drawn on the keyboard picture 171 is touched by the finger of the player, the pitch value with the specific pitch can be obtained.

Next, the pitch value calculated at the above step S940 is stored into a reference pitch value register (step S950). Subsequently, the coordinate values of the X axis and the Y axis are saved into an X-reference coordinate value register and a Y-reference coordinate value register, respectively. These storage contents of the reference pitch value register and the X- and Y-reference coordinate value register are used in a movement event process (which will be described later). Next, the process operation is advanced to a step S970.

If such a judgement is made such that the event type is not turned ON, namely a process operation for a movement process is presently executed at the above step S920, then a calculation is done as to a difference pitch value between the coordinate value of the X axis and the reference coordinate value of the X axis (step S980). In other words, a difference pitch value from the first touched position is calculated. Subsequently, this difference pitch value is added to the reference pitch value to thereby obtain a final pitch value (step S990). Thereafter, the process operation is branched to a step S970.

At this step S970, the final pitch value calculated in the above-described respective process operations is stored into a present data region. The content of this present data region will constitute the final pitch value calculated in the event process, and is used so as to generate a tone in a note-on process (step S660). Thereafter, the sequential operation is returned from this pitch value calculation process routine to a touch-on process routine.

In the touch-on process routine, a process operation for calculating an X parameter from the X-axis coordinate value is carried out (step S610). The parameter value calculation processes of the respective axes are executed in a parameter value calculation process routine shown in FIG. 20.

3-1-2) PARAMETER VALUE CALCULATION PROCESS

In the parameter value calculating process, parameter information is first inputted (step S800). In this case, the parameter information implies data for defining music performance information allocated to each of the X, Y and Z axes. This parameter information is constituted by, for instance, a sort, a range, a bit width, and an input mode. Next, a check is done as to whether or not the present mode corresponds to the absolute value mode (step S810). When it is judged at this step S810 that the present mode is the absolute value mode, the coordinate value is directly converted into a parameter value (step S820). Subsequently, the process operation is branched to a step S860.

To the contrary, when it is so judged at the above step S810 that the present mode is not equal to the absolute value mode, a check is subsequently done as to whether or not an event type is turned ON (step S830). Then, if it is so judged that the event type is turned ON, namely the process operation for the touch-on process is presently carried out, then the coordinate value is stored into a reference coordinate value register (step S840). The storage content of this reference coordinate value register will be utilized in a step S870 described later. Next, a default value is set as a parameter value (step S850). As a result, in such a case that a touch-on event happens to occur, namely the touch panel 170 is first touched, this default value is used as the parameter value, so that the musical performance information is produced. Thereafter, the process operation is advanced to a step S860.

If such a judgement is made such that the event type is not turned ON, namely a process for the movement process is presently executed at the above step S830, then a calculation is done as to a difference parameter value between the coordinate value and the reference coordinate value in the reference coordinate value register (step S870). In other words, a difference parameter value from the first touched position is calculated. Subsequently, this difference parameter value is added to the default value to thereby obtain a final parameter value (step S880). Thereafter, the process operation is branched to a step S860.

At this step S860, the final parameter value calculated in the above-described respective process operations is stored into the present data region. The content of this present data region will constitute the final music performance information calculated in the event process, and is utilized so as to generate a tone in the note-on process (step S660). Thereafter, the sequential operation is returned from this parameter value calculation process routine to a touch-on process routine.

In this touch-on process routine, a process operation for calculating a Y parameter 1 from the Y-axis coordinate value is carried out (step S620). A parameter value calculation process is executed in the above-described parameter value calculation process routine shown in FIG. 20. This parameter value calculation process operation is similarly carried out in the below-mentioned other parameters. Subsequently, a Y parameter 2 is calculated from the coordinate value of the Y axis (step S630), a Z parameter 1 is calculated from the coordinate value of the Z axis (step S640), and a Z parameter 2 is calculated from the coordinate value of the Z axis (step S650). When the above-explained respective parameter calculation processes are accomplished, the present data region is brought into such a condition that the music performance information containing the parameters required to generate the musical tones has been stored.

Next, a note-on process is executed (step S660). In this note-on process, the data stored in the above-described present data region is sent to the tone generator 150. Accordingly, the tone generator 150 starts to produce a musical tone signal based on the music performance information entered by manipulating the touch panel 170. Then, this musical tone signal is supplied to the sound system 160, so that the musical tone is generated. Thereafter, the sequential operation is returned from this touch-on process routine to the event process routine.

In the event process routine, a touch-on flag is subsequently cleared (step S420). As a consequence, no touch-on process is performed until the next touch-on event happens to occur. Thereafter, the sequential operation is returned from this event process routine to the main process routine.

When it is judged at the above step S400 that the touch-on event does not occur, a check is made as to whether or not the touch-off event happens to occur (step S430). Then, when it is judged that the touch-off event occurs, a touch-off process is carried out (step S440). A detailed content of this touch-off process operation is shown in a flow chart of FIG. 18.

3-2) TOUCH-OFF PROCESS

In the touch-off process, a note-off process is carried out (step S670). In other words, the CPU 200 transmits predetermined data to the tone generator 150. As a result, an envelope of a musical tone under generation is attenuated to stop the tone generation. Next, the sequential operation is returned from this note-off process routine to the event process routine.

In the event process routine, a touch-off flag is subsequently cleared (step S450). As a consequence, no touch-off process is performed until the next touch-off event happens to occur. Thereafter, the sequential operation is returned from this event process routine to the main process routine.

When it is judged at the above step S430 that the touch-off event does not occur, a check is made as to whether or not the movement event happens to occur (step S460). This check is performed with reference to the above-described movement flag. When such a judgement is made that the movement event happens to occur, a movement process is carried out (step S470). A detailed operation of this movement process operation is represented in a flow chart of FIG. 19.

3-3) MOVEMENT PROCESS

In this movement process, a check is first made as to whether or not a movement X-flag is turned ON (step S700). At this time, when it is judged that the movement X-flag is turned ON, a pitch value calculating process is carried out based upon the coordinate value of the X (Y) axis (step S710). Next, a process operation for calculating an X parameter from the coordinate value of the X axis is performed (step S720). Each of these process operations are identical to those defined from the step S600 to the step 610. Thereafter, the sequential operation is returned from this movement process routine to the event process routine.

When it is so judged at the above step S700 that the movement X-flag is not turned ON, another check is subsequently carried out as to whether or not the movement Y-flag is turned ON (step S730). In this case, when such a judgement is made that the movement Y-flag is turned ON, another process operation for calculating a Y parameter 1 from the coordinate value of the Y axis is executed (step S740). Next, a further process operation for calculating a Y parameter 2 from the coordinate value of the Y axis is performed (step S750). The respective process operations are the same as those defined at the step S620 and the step S630. Thereafter, the sequential operation is returned from this movement process routine to the event process routine.

When it is so judged at the above step S730 that the movement Y-flag is not turned ON, another check is subsequently carried out as to whether or not the movement Z-flag is turned ON (step S760). In this case, when such a judgement is made that the movement Z-flag is turned ON, another process operation for calculating a Z parameter 1 from the coordinate value of the Z axis is executed (step S770). Next, a further process operation for calculating a Z parameter 2 from the coordinate value of the Z axis is performed (step S780). The respective process operations are the same as those defined at the step S640 and the step S650. Thereafter, the sequential operation is returned from this movement process routine to the event process routine.

With execution of the above-described movement process operations, such data for newly designating the pitch, volume, timbre, and musical effect are stored in the present data region so as to be utilized for the tone generation.

In the event process routine, the movement flag is subsequently cleared (step S480). As a result, no movement process is carried out until the subsequent movement event happens to occur. Thereafter, this sequential operation is returned from the above-explained event process routine to the main process routine.

When it is judged at the above step S460 that the present event is not the movement event, a check is subsequently done as to whether or not a switch event happens to occur (step S490). This check is performed by investigating the switching conditions of the respective switches acquired from the operation panel 300. Then, when it is so judged that the switch event happens to occur, the switch process operation is carried out (step S500). This switch process corresponds to a process operation for realizing the function of the switch where the event has occurred. For instance, when an ON-event of a switch in the timbre selecting switch group 303 happens to occur, a process operation for selecting timbre is carried out. Subsequently, a switch flag is cleared (step S510). As a consequence, no switch process operation is carried out until the next switch event happens to occur. Thereafter, the sequential operation is returned from this event process routine to the main process routine.

What is claimed is:

1. A music performance information inputting apparatus for inputting music performance information to be supplied to an electronic musical instrument, comprising:

a touch panel for outputting coordinate data corresponding to a touched position;

a parameter table for storing a plurality of types of basic music performance data each of which includes a parameter;

a parameter allocating switch for selecting one from said plurality of types of basic music performance data stored in said parameter table to allocate to said touch panel;

a bender mode switch for designating anyone of an absolute value mode and a relative value mode; and music performance information producing means for producing a type of music performance data by replacing the parameter included in said selected type of basic music performance data by the coordinate data outputted from said touch panel when said absolute value mode is designated, and producing the type of music performance data by replacing said parameter by difference data comprising a difference between coordinate data of a first touched position and coordinate data of a present touched position when said relative value mode is designated.

2. A music performance information inputting apparatus according to claim 1, wherein said parameter allocating switch comprises:

an X parameter allocating switch for selecting one of said plurality of types of basic music performance data stored in said parameter table to allocate to an X axis of said touch panel; and a Y parameter allocating switch for allocating said selected type of basic music performance data to a Y axis of said touch panel, wherein said music performance information producing means produces a type of music performance data by replacing at least a part of the parameter included in said selected type of basic music performance data by X coordinate data outputted from said touch panel and replacing at least another part of said parameter by Y coordinate data outputted from said touch panel when said absolute value mode is designated, and produces the type of music performance data by replacing at least the part of the parameter by difference data comprising a difference between X coordinate data of a first touched position and X coordinate data of a present touched position and replacing at least the other part of the parameter by difference data comprising a difference between Y coordinate data of the first touched position and Y coordinate data of the present touched position when said relative value mode is designated.

3. A music performance information inputting apparatus according to claim 2, wherein each of the plurality of types of basic music performance data further includes a channel number, the apparatus further comprising:

a channel selecting switch for selecting a channel used to generate a musical tone, wherein said music performance information producing means produces a type of music performance data by replacing the channel number in said selected type of basic music performance data by a channel number corresponding to the channel selected by said channel selecting switch.

4. A music performance information inputting apparatus according to claim 1, wherein said parameter allocating switch comprises:

an X parameter allocating switch for selecting one of said plurality of types of basic music performance data stored in said parameter table to allocate to an X axis of said touch panel; and a Y parameter allocating switch for selecting another one of said plurality of types of basic music performance data stored in said parameter table to allocate to a Y axis of said touch panel, wherein said music performance information producing means produces a type of music performance data by replacing the parameter included in said selected type of basic music performance data by X coordinate data outputted from said touch panel, and produces another type of music performance data by replacing the parameter included in said other selected type of basic music performance data by Y coordinate data outputted from said touch panel when said absolute value mode is designated, and produces the type of music performance data by replacing the parameter by difference data comprising a difference between X coordinate data of a first touched position and X coordinate data of a present touched position, and produces the other type of music performance data by replacing the parameter by difference data comprising a difference between Y coordinate data of the first touched position and Y coordinate data of the present touched position when said relative value mode is designated.

5. A music performance information inputting apparatus according to claim 4, wherein each of the plurality of types of basic music performance data further includes a channel number, the apparatus further comprising:

a channel selecting switch for selecting a channel used to generate a musical tone, wherein said music performance information producing means produces a type of music performance data by replacing the channel number included in said selected type of basic music performance data by a channel number corresponding to the channel selected by said channel selecting switch, and produces another type of music performance data by replacing the channel number included in said other selected type of basic music performance data by the channel number corresponding to the channel selected by said channel selecting switch.

6. A performance information inputting apparatus according to claim 1, wherein each of the plurality of basic music performance data further includes a status, the apparatus further comprising:

a bender range selecting switch for selecting a bender range to restrict a change range of a pitch, wherein said music performance information producing means produces a plurality of types of music performance data used to set the bender range selected by said bender range selecting switch to said electronic musical instrument every time said bender range selecting switch is operated.

7. A music performance information inputting apparatus according to claim 1, wherein said selected type of basic music performance data allocated to said touch panel by said parameter allocating switch comprises a status indicative of a pitch bend.

8. A music performance information inputting apparatus according to claim 1, further comprising:

transmitting means for transmitting said type of music performance data to an external appliance such that a sound is generated or modified based on said type of music performance data;

an input terminal for inputting a type of external music performance data externally supplied; and a merging means for inserting said type of external music performance data inputted from said input terminal into a train of said type of music performance data produced by said music performance information producing means, wherein said transmitting means transmits the train of said type of music performance data in which external music performance data is inserted by said merging means to an external appliance through an output terminal.

9. An electronic musical instrument comprising:

a touch panel on which a keyboard picture is formed for outputting an X coordinate value and a Y coordinate value corresponding to a touched position;

a mode flag for designating whether or not an absolute value mode is set;

music performance information producing means for producing a first type of music performance data by using the X coordinate value outputted from said touch panel as an absolute value and for producing a second type of music performance data by using the Y coordinate value outputted from said touch panel as an absolute value when said mode flag designates that the absolute value mode is set, and for producing a first type of music performance data by using the X coordinate value outputted from said touch panel as a relative value to a value derived from a first touch position and for producing a second type of music performance data by suing the Y coordinate value outputted from said touch panel as a relative value to a value derived from the first touch position when said mode flag designates that the absolute mode is not set; and musical tone generating means for generating a musical tone based on said first and second types of music performance data produced by said music performance information producing means.

10. The electronic musical instrument according to claim 9, wherein said music performance information producing means generates a musical tone having a pitch based on the first type of music performance data.

11. An electronic musical instrument according to claim 9, wherein said music performance information producing means produces said first type of music performance data and a third type of music performance data by using the X coordinate value outputted from said touch panel as an absolute value and produces said second type of music performance data and a fourth type of music performance data by using the Y coordinate value outputted from said touch panel as an absolute value when said mode flat designates that the absolute value mode is set, and produces a first type of music performance data and a third type of music performance data by using the X coordinate value outputted from said touch panel as a relative value to a value derived from a first touch position and produces a second type of music performance data and a fourth type of music performance data by using the Y coordinate value outputted from said touch panel as a relative value to a value derived from the first touch position when said mode flag designates that the absolute mode is not set, and said musical tone generating moans generates a musical tone based on said first to fourth types of music performance data produced by said music performance information producing means.

12. An electronic musical instrument according to claim 9, wherein said music performance information producing means produces said first type of music performance data to generate a musical tone having a pitch which is assigned to a key draw on said keyboard picture by using the X coordinate value outputted from said touch panel as an absolute value and produces said second type of music performance data by using the Y coordinate value outputted from said touch panel as an absolute value when said mode flag designates that the absolute value mode is set, and produces said first type of music performance data to generate a musical tone having a pitch which is assigned to a key draw on said keyboard picture by using the X coordinate value outputted from said touch panel as a relative value to a value derived from a first touch position and produces a second type of music performance data by using the Y coordinate value outputted from said touch panel as a relative value to a value derived from the first touch position when said mode flag designates that the absolute mode is not set.

13. An electronic musical instrument according to claim 12, wherein said music performance information producing means produces said first type of music performance data and a third type of music performance data by using the X coordinate value outputted from said touch panel as an absolute value and produces said second type of music performance data and a fourth type of music performance data by using the Y coordinate value outputted from said touch panel as an absolute value when said mode flag designates that the absolute value mode is set, and produces a first type of music performance data and a third type of music performance data by using the X coordinate value outputted from said touch panel as a relative value to a value derived from a first touch position and produces a second type of music performance data and a fourth type of music performance data by using the Y coordinate value outputted from said touch Panel as a relative value to a value derived from the first touch position when said mode flag designates that the absolute mode is not set, and said musical tone generating means generates a musical tone based on said first to fourth types of music performance data produced by said music performance information producing means.

14. An electronic musical instrument according to claim 9, wherein said music performance information producing means produces said first type of music performance data to generate a musical tone having a pitch which is assigned to a key draw on said keyboard picture by using the X coordinate value outputted from said touch panel as an absolute value when said touch panel is touched, and produces said another type of music performance data to change the pitch according to a movement quality of the touched position when the touched position is moved while touching to said touch panel.

15. An electronic musical instrument comprising:

a touch panel on which a keyboard picture is formed for outputting an X coordinate value, a Y coordinate value and a Z coordinate value corresponding to a touched position;

a mode flag for designating whether or not an absolute value mode is set;

music performance information producing means for producing a first type of music performance data by using the X coordinate value outputted from said touch panel as an absolute value, for producing a second type of music performance data by using the Y coordinate value outputted from said touch panel as an absolute value, and for producing a third type of music performance data by using the Z coordinate value outputted from said touch panel as an absolute value when said mode flag designates that the absolute value mode is set, and for producing a first type of music performance data by using the X coordinate value outputted from said touch panel as a relative value to a value derived from a first touch position for producing a second type of music performance data by using the Y coordinate value outputted from said touch panel as a relative value to a value derived from the first touch position, and for producing a third type of music performance data by using the Z coordinate value outputted from said touch panel as a relative value to a value derived from the first touch position when said mode flag designates that the absolute mode is not set; and musical tone generating means for generating a musical tone based on said first to third types of music performance data produced by said music performance information producing means.

16. An electronic musical instrument according to claim 15, wherein the music performance information producing means generates a musical tone having a pitch based on the first type of music performance data.

17. An electronic musical instrument according to claim 15, wherein said music performance information producing means produces said first type of music performance data and a fourth type of music performance data by using the X coordinate value outputted from said touch panel as an absolute value, produces said second type of music performance data and a fifth type of music performance data differ from said first type of music performance data by using the Y coordinate value outputted from said touch panel as an absolute value, and produces said third type of music performance data and a sixth type of music performance data by using the Z coordinate value outputted from said touch panel as an absolute value when said mode flag designates that the absolute value mode is set, and produces a first type of music performance data and a fourth type of music performance data by using the X coordinate value outputted from said touch panel as a relative value to a value derived from a first touch position and produces a second type of music performance data and a fifth type of music performance data differ from said first type of music performance data by using the Y coordinate value outputted from said touch panel as a relative value to a value derived from the first touch position, and Produces a third type of music performance data and a sixth type of music performance data by using the Z coordinate value outputted from said touch panel as a relative value to a value derived from the first touch position when said mode flag designates that the absolute mode is not set, and said musical tone generating means generates a musical tone based on said first to sixth types of music performance data produced by said music performance information producing means.

18. An electronic musical instrument according to claim 15, wherein said music performance information producing means produces said first type of music performance data to generate a musical tone having a pitch which is assigned to a key draw on said keyboard picture by using the X coordinate value outputted from said touch panel as an absolute value, produces said second type of music performance data by using the Y coordinate value outputted from said touch panel as an absolute value, and produces said third type of music performance data by using the Z coordinate value outputted from said touch panel as an absolute value when said mode flag designates that the absolute value mode is set, and produces said first type of music performance data to generate a musical tone having a ditch which is assigned to a key draw on said keyboard picture by using the X coordinate value outputted from said touch panel as an relative value to a value derived from a first touch position, produces said second type of music performance data by using the Y coordinate value outputted from said touch panel as an relative value to a value derived from the first touch position, and produces said third type of music performance data by using the Z coordinate value outputted from said touch panel as an relative value to a value derived from the first touch position when said mode flag designates that the absolute value mode is not set.

19. An electronic musical instrument according to claim 18, wherein said music performance information producing means produces said first type of music performance data and a fourth type of music performance data by using the X coordinate value outputted from said touch panel as an absolute value, produces said second type of music performance data and a fifth type of music performance data by using the Y coordinate value outputted from said touch panel as an absolute value, and produces said third type of music performance data and a sixth type of music performance data by using the Z coordinate value outputted from said touch panel as an absolute value when said mode flag designates that the absolute value mode is set, and produces said first type of music performance data and a fourth type of music performance data by using the X coordinate value outputted from said touch panel as a relative value to a value derived from a first touch position, produces said second type of music performance data and a fifth type of music performance data by using the Y coordinate value outputted from said touch panel as an relative value to a value derived from the first touch position, and produces said third type of music performance data and a sixth type of music performance data by using the Z coordinate value outputted from said touch panel as an relative value to a value derived from the first touch position when said mode flag designates that the absolute value mode is not set, and wherein said musical tone generating means generates a musical tone based on said first to sixth types of music performance data produced by said music performance information producing means.

* * * * *